US011111671B2

(12) United States Patent
Chigot et al.

(10) Patent No.: US 11,111,671 B2
(45) Date of Patent: Sep. 7, 2021

(54) METHODS AND TILE FOR USE IN A FALSE CEILING OR WALL AND A FALSE CEILING OR WALL

(71) Applicant: SAINT-GOBAIN ECOPHON AB, Hyllinge (SE)

(72) Inventors: Pierre Chigot, Helsingborg (SE); Emma Arvidsson, Helsingborg (SE)

(73) Assignee: SAINT- GOBAIN ECOPHON AB, Hyllinge (SE)

( * ) Notice: Subject to any disclaimer, the term of this patent is extended or adjusted under 35 U.S.C. 154(b) by 0 days.

(21) Appl. No.: 15/510,852

(22) PCT Filed: Sep. 18, 2015

(86) PCT No.: PCT/EP2015/071501

§ 371 (c)(1),
(2) Date: Mar. 13, 2017

(87) PCT Pub. No.: WO2016/042151

PCT Pub. Date: Mar. 24, 2016

(65) Prior Publication Data

US 2017/0275878 A1 Sep. 28, 2017

(30) Foreign Application Priority Data

Sep. 19, 2014 (EP) ..... 14185550

(51) Int. Cl.
*E04B 9/06* (2006.01)
*E04B 9/04* (2006.01)
(Continued)

(52) U.S. Cl.
CPC ..... *E04B 9/061* (2013.01); *E04B 9/04* (2013.01); *E04B 9/363* (2013.01); *E04B 9/225* (2013.01); *E04B 2103/04* (2013.01); *E04F 13/16* (2013.01)

(58) Field of Classification Search
CPC . E04B 9/061; E04B 9/04; E04B 9/363; G06F 17/50; G06F 17/5009; G06F 30/00; G06F 30/20
See application file for complete search history.

(56) References Cited

U.S. PATENT DOCUMENTS 3,077,426 A 2/1963 Johnston
6,318,042 B1 11/2001 Bloom et al.
(Continued)

FOREIGN PATENT DOCUMENTS

EP 2090707 A1 8/2009
EP 2339083 A1 6/2011
(Continued)

OTHER PUBLICATIONS

Gudavicius, Dainius ("New Powerful Solution Has Been Released for Autodesk® Revit® MEP Users! Smart Hangers", http://www.aga-cad.com/blog/new-powerful-solution-has-been-released-for-autodesk-revit-mep-users , Oct. 17, 2013). (Year: 2013).*
(Continued)

*Primary Examiner* — Omar F Fernandez Rivas
*Assistant Examiner* — Joshua E. Jensen
(74) *Attorney, Agent, or Firm* — Brundidge & Stanger, P.C.

(57) ABSTRACT

The claimed invention describes a method of preparing an installation of a 3-dimensionally extending false ceiling or wall. The claimed method includes calculating format, position and orientation for each individual flat tile in the suspended ceiling or wall, associating each individual flat tile with a unique tile identity, producing the individual flat tiles according to the calculated format, providing respective flat tile with the tile identity of respective tile, and providing a representation of the 3-dimensionally extending suspended
(Continued)

ceiling or wall including an association of the position of respective flat tile with respective tile identity.

8 Claims, 14 Drawing Sheets

(51) Int. Cl.
*E04B 9/36* (2006.01)
*E04B 9/22* (2006.01)
*E04F 13/16* (2006.01)

(56) References Cited

U.S. PATENT DOCUMENTS

| | | | | |
|---|---|---|---|---|
| 2005/0116667 | A1* | 6/2005 | Mueller | E04F 13/08 315/312 |
| 2015/0027075 | A1* | 1/2015 | Wilkens | E04B 9/28 52/385 |
| 2015/0240490 | A1* | 8/2015 | Firinga | E04B 9/12 52/506.05 |
| 2015/0300016 | A1* | 10/2015 | Bergman | E04B 9/0435 52/506.06 |
| 2016/0053489 | A1* | 2/2016 | Porter | F16B 5/0225 52/506.08 |

FOREIGN PATENT DOCUMENTS

| | | | | |
|---|---|---|---|---|
| EP | 2662504 | A1 | 11/2013 | |
| JP | H05321391 | | 12/1993 | |
| SE | 460371 | B | 10/1989 | |
| WO | WO-01/48333 | A1 * | 7/2000 | E04F 15/04 |
| WO | 01/48333 | A1 | 7/2001 | |
| WO | 2007/038989 | A1 | 4/2007 | |

OTHER PUBLICATIONS

Chigot, Pierre. "Office buildings and natural cooling: room acoustic demands and influence of acoustic treatment on thermal performance." Proceedings of Inter-Noise, 39th International Congress and Exposition on Noise Control Engineering. Lisbon. 2010. (Year: 2010).*

Al-Sallal, Khaled A. "Testing glare in universal space design studios in Al-Ain, UAE desert climate and proposed improvements." Renewable energy 32.6 (2007): 1033-1044. (Year: 2007).*

International Search Report and Written Opinion from International Application No. PCT/EP2015/071501 dated Nov. 20, 2015.

* cited by examiner

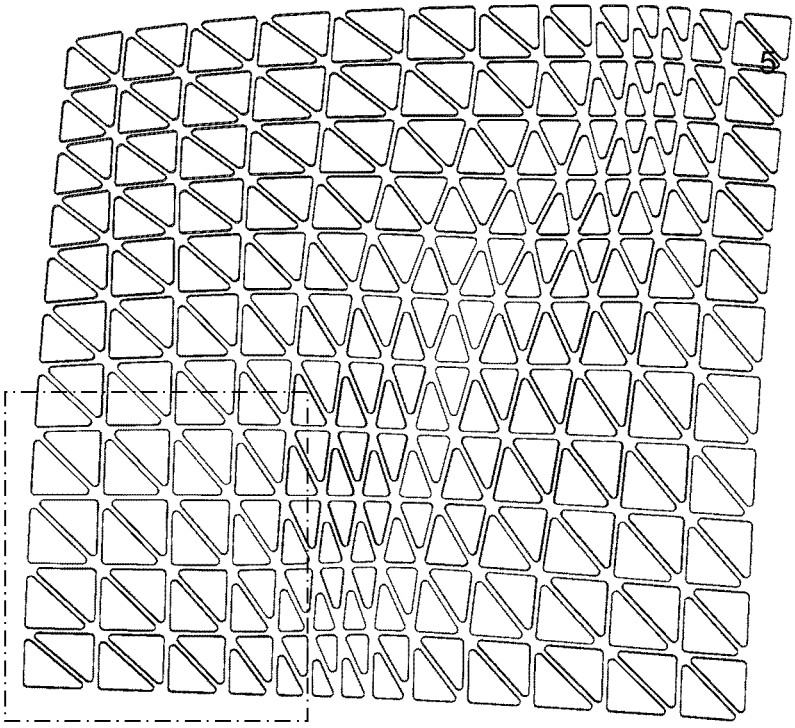
Fig 2
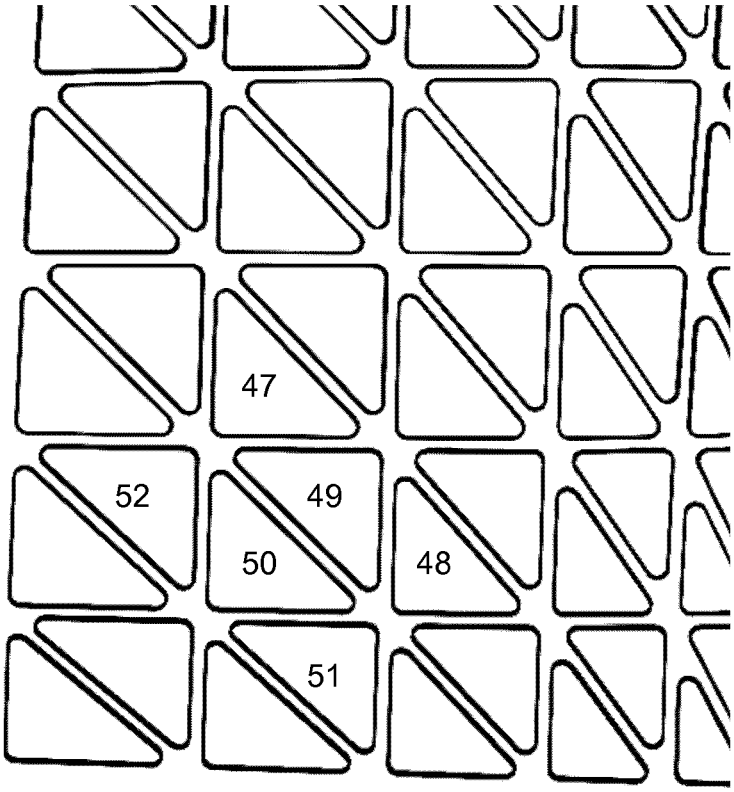

METHODS AND TILE FOR USE IN A FALSE CEILING OR WALL AND A FALSE CEILING OR WALL

FIELD OF INVENTION

The invention relates to a method of preparing an installation of a false ceiling or wall comprising a plurality of ceiling or wall tiles, the tiles being mineral fibre based tiles, each having a front major surface being adapted to be visible, an opposing back major surface and one or more edge surfaces extending along the perimeter of the tile and connecting the front and back major surfaces.

The invention also relates to a method of installing a false ceiling or wall comprising a plurality of ceiling or wall tiles, the tiles being mineral fibre based compressed tiles, each having a front major surface being adapted to be visible, an opposing back major surface and one or more edge surfaces extending along the perimeter of the tile and connecting the front and back major surfaces.

The invention also relates to a tile for use in a false ceiling or wall comprising a plurality of tiles, the tile being a mineral fibre based tile having a front major surface being adapted to be visible, an opposing back major surface and one or more edge surfaces extending along the perimeter of the tile and connecting the front and back major surfaces.

The invention also relates to a false ceiling or false wall including a plurality of tiles.

TECHNICAL BACKGROUND

A false ceiling is a kind of ceiling where tiles or the like are attached to or suspended from a framework or structure of a building. When the tiles of the false ceiling are suspended from a framework or the main structure of a building, the false ceiling is sometimes named suspended ceiling. Historically, false ceilings or suspended ceilings have been designed as a plurality of rectangular or quadratic tiles supported by the flanges of profiles. The profiles are typically arranged with a first set of profiles extending in parallel with each other and a second set of profiles extending in parallel with each other and perpendicular to the first set of profiles, the profiles thereby forming a rectilinear grid system. The grid system may e.g. be suspended from a structure or a framework of a building by a plurality of wires. A modern variant of such a suspended ceiling is e.g. disclosed in U.S. Pat. No. 6,318,042 B1.

Through-out the years, architects has expressed a wish of being able to design the suspended ceilings in various ways to be able to meet aesthetic considerations to a greater extent. On the other hand, there is also a wish to keep manufacturing, transportation and installation of the suspended ceilings easy and cost-efficient. Other requirements to consider are various properties, such as acoustical properties, lighting, ventilation, heating/cooling, etc.

In this context it is considered relevant to mention different designs where the above mentioned wishes and requirements have been addressed.

SE 460 371 B discloses curved tiles. EP 2 339 083 A1 discloses foldable tiles.

EP 2 090 707 A1 discloses a method of installing a suspended ceiling where a set of tiles forms a perimeter at a first level and the other tiles in the suspended ceiling are provided at a different level.

EP 2 662 504 discloses a tile for a non-planar suspended ceiling. The groove arrangements (by which the tile is supported by the flanges of the profiles of the grid system) are arranged such that the ceiling tile in an installed state is inclined with respect to the horizontal plane.

SUMMARY OF INVENTION

It is an object of the invention to address the above issues concerning providing a high degree of design freedom and keeping manufacturing, transportation and installation of the false ceilings (such as suspended ceilings) easy and cost-efficient.

This object has been achieved by a method of preparing an installation of a false ceiling or wall comprising a plurality of ceiling or wall tiles, the tiles being mineral fibre based tiles, each having a front major surface being adapted to be visible, an opposing back major surface and one or more edge surfaces extending along the perimeter of the tile and connecting the front and back major surfaces, as indicated in the introductory part of the specification and relating to the preparation of an installation of a false ceiling or wall, preferably a suspended ceiling or wall.

The method is characterised in that it comprises:

calculating format, position and orientation for each individual tile in the suspended ceiling or wall, associating each individual tile with a unique tile identity, producing the individual tiles according to the calculated format, providing respective tile with the tile identity of respective tile, providing a representation of the false (preferably suspended) ceiling or wall including an association of the position of respective tile with respective tile identity.

In this context a false ceiling is a kind of inner ceiling where tiles or the like are attached to or suspended from a framework or a structure of a building. When the tiles of the false ceiling are suspended from a framework or the main structure of a building, the false ceiling is considered to belong to the sub-group suspended ceiling. The suspended ceilings may e.g. be formed of separately suspended tiles or by the tiles being installed in a grid system of elongate profiles being suspended from a framework or the main structure of a building. Similarly as for a ceiling the same nomenclature (concerning false and suspended) applies for tiles forming an inner wall. The tiles may be suspended directly from the framework or main structure of the building. Alternatively, the framework may be formed of an intermediate framework attached to or suspended from the framework or main structure of the building. The intermediate framework may e.g. be in the form of a grid system formed of a plurality of elongated profiles. By providing the framework in the form of an intermediate framework it is easier to provide a well-defined framework forming a well-defined reference for the false ceiling or wall compared to using the framework or structure of the building directly.

This method of preparation of an installation of a false or suspended ceiling or wall, allows the designer to design every single tile with a unique format. Format in this context includes at least shape and size. Moreover, it allows the designer to position and to orient every single tile in a unique position and a unique orientation. It allows the designer to design the false or suspended ceiling or wall e.g. with any desired pattern of tiles of different shapes and sizes. Alternatively or as a complement, it also allows the designer to design a false or suspended ceiling or wall having a 3-dimensional extension. The false or suspended ceiling may be given the shape of a complex 3-dimensionally extending surface. It is contemplated that the shape may include tiles with curved major surfaces or otherwise shaped tiles. However, one advantage of the invention is that it becomes possible to provide complex 3-dimensional ceilings or walls only using flat tiles. Flat tiles have the advantage of being easy to produce and to transport. It is contemplated that the shape may include tiles with a curved perimeter. The curvature may be a single curvature, as in a circle, but may also include a number of different curves of different sizes and/or a system of convex and concave curves and/or combinations of curves with other shapes such as straight lines. If the tiles are intended to be supported in a grid system of longitudinally extending profiles, it is preferred that the tiles are shaped as flat polygons, such as triangles, rectangles, and pentagons, etc. It is contemplated that the grid system may include longitudinally extending profiles that have a curved shape along their longitudinal extension. The curved shape may be provided as a continuous curved shape of one or more curvatures after each other. The curved shape may also be provided as a set of straight lines at different angles relative to each other. The curvature may be provided in a plane or as a three-dimensional shape. The continuous curved shape is useful for cases where the tiles have a continuously shaped curvature. The set of mutually angled straight lines is useful for cases where the tiles are planar. It is also contemplated that the profiles may be curved in a combination of the continuous curvature and the mutually angled straight lines. This may e.g. be useful where the false ceiling or wall includes planar tiles with a curved perimeter. In such a case the profiles may e.g. have a continuous curvature in one direction to follow a curved perimeter of the tiles and have a curvature of mutually angled straight lines in a second direction (transverse to the first direction) to accommodate the different angular positions of the neighbouring planar tiles.

By calculating the format, position and orientation for each individual tile it is possible to provide almost any desired shape of the ceiling or wall. It is e.g. possible to provide a complex 3-dimensional ceiling or wall with only flat tiles and still without any unwanted gaps between the tiles, i.e. with no gaps or only desired gaps between the tiles.

In order to transform such a representation of the wall to a set of tiles that may be installed and form a physical ceiling or wall, each tile is associated with a unique tile identity. The tiles are produced according to calculated format and each tile is provided with its unique tile identity. The tile identity may be provided on the tile in the form of a number, a combination of letters and numbers or other relevant signs. The tile identity may be e.g. printed, embossed, or milled onto the back major surface. It is also contemplated that e.g. an RFID-tag is used to carry the tile identity. The tile identity may later on be used by a ceiling or wall installer to correctly and uniquely identify each tile. In order to facilitate installation of the tiles to form the ceiling or wall, there is also provided a representation of the suspended ceiling or wall including an association of the position of respective tile with respective tile identity. The representation may e.g. be in the form of a table identifying the tiles and their intended relationship with other tiles or a drawing of the suspended ceiling or wall upon which drawing the tile identities are noted in respective representation of respective tile. It is also contemplated that the representation comprises both a table and a drawing. The tile identities may on the representation be noted in full or alternatively only be noted partly. The latter may e.g. be useful if the tile identities include information that is not necessary to use to distinguish one tile from another at the installation site. Such non-unique part of the in total unique tile identity may be information e.g. relating to project name, site, building, room, client, type of tile, etc. In such a case it may be useful that the representation for clarity reasons only includes the data necessary to distinguish one tile from another at the actual site of installation.

Mineral fibre based tile includes e.g. tiles formed of entangled glass fibres being compressed to form a tile and tiles formed of entangled stone fibres or stone wool being compressed to form a tile. The tiles preferably have a sound absorption, $\alpha_w$, according to EN ISO 11654, of at least 0.5.

Preferred embodiments of the invention appear in the dependent claims.

Each tile may be provided with a tile identity or tile identities of neighbouring tile or tiles. This may used for the person installing the ceiling or wall to securely install respective tile in the correct orientation. It also facilitates the next step for the person installing the ceiling, since the identities of the next tiles to be retrieved and installed are indicated on the tile presently being installed.

Each tile may be provided with an identification of which of the edge surfaces or which part or parts of the edge surface is/are intended to be facing a certain neighbouring tile. This may be accomplished by a printed indicator, such as an arrow, indicating the relevant edge surface or relevant part of the edge surface and information about the identity of the relevant neighbouring ceiling tile. The indicator may alternatively, or as a complement, be in the form of the location of the information concerning the identity of the neighbouring ceiling tile, such as providing the information regarding the identity of a neighbouring ceiling tile dose to the edge intended adjoin the neighbouring ceiling tile, or at least closer to the edge intended to adjoin said neighbouring than to the information about the identity of the ceiling tile provided with said information. This may also be complemented with a marker, such as a line or the like, which is intended to be adjusted in position relative to a marker on the neighbouring tile.

The method may further comprise providing a set of input data representing a framework or a space defined by said framework or a surface that said ceiling or wall is intended to form, calculating based on said set of input data, format, position, and orientation, for each individual tile in the false ceiling or wall, providing a set of output data representing said ceiling or wall formed by said tiles for visualization of the intended ceiling or wall in the context of the framework of the building.

The input data may be imported completely from another software program or be imputed directly into the calculating software or be partly imported and partly be inputted directly. The output data may be used to visualize the ceiling or wall on the same computer running the calculating software or on a different computer being remote from the one running the calculating software.

In one embodiment the designer inputs the data representing the building or space on his local computer to the computer(s) running the calculating software via an internet interface. The computer(s) running the calculating software performs the calculation based on the input data and provides output data for visualization on the designer's local computer via an internet interface. The designer may e.g. communicate with the computer running the calculating software via a web browser. Alternatively, the software may be installed and run locally on the designer's local computer.

In one embodiment the method further comprises importing a set of input data, which has been provided on a first computer and which represents a framework or a space defined by said framework or a surface that said ceiling or wall is intended to form, from said first computer via a network interface to a second computer, remote from said first computer, calculating, on said second computer and based on said set of input data, format, position, and orientation, for each individual tile in the false ceiling or wall, exporting a set of output data representing said ceiling or wall formed by said tiles, from said second computer via a network interface to said first computer, wherein the first computer is adapted to visualize the intended ceiling or wall e.g. in the context of the framework of the building, This set-up makes it efficient e.g. for an architect designing a complete building to provide input data in his own design software on his computer (an example of a first computer). This data is then imported into a second computer, e.g. in the tile manufacturers computer system. The tile manufacturer may provide the software that calculates the format, position and orientation for each individual ceiling tile. The tile manufacturer may also provide boundary conditions concerning what is technically feasible e.g. in respect of the tiles being possible to manufacture or possible to support in the desired manner. The second computer then exports output data representing the ceiling or wall and the architect may visualise the result of the calculations on his computer in the context of the building.

The method may further comprise calculating for a plurality of the tiles positions of at least one connection point on respective tile, wherein a connection element is adapted to be connected to respective tile at respective connection point, wherein the connection element is adapted to directly or indirectly connect said tile to a neighbouring tile, and providing respective tile with a marking on its major back surface, the marking indicating the position of said connection point.

This will facilitate correct positioning of the connection element in relation to the tile and will in turn facilitate correct positioning of the tile in relation to its neighbouring tiles.

The tiles may be adapted to be connected to and suspended to a framework by a plurality of elongated suspension elements, the method further comprising calculating positions of connection points on the tiles or on connection elements interconnecting tiles at which connection points the suspension elements are adapted to be attached to the tiles or to the connection elements for suspension of the tiles, calculating, for each suspension element, an attachment position at which attachment position the suspension element is adapted to be attached to the framework, the calculation being performed relative to a representation of the framework, the calculation also includes calculation of orientation and length of said suspension element, associating each individual suspension element with a unique suspension element identity, providing a representation of the suspended ceiling or wall including an association of the attachment position of respective suspension element with respective suspension element identity and including information concerning calculated orientation and length of respective suspension element with respective suspension element identity.

This method of calculating the connection points, the attachment points, the orientation and the length of respective suspension element and associating this information to a suspension element identity and providing a representation of the ceiling or wall associating the attachment position with the suspension element identity makes it easy for the person installing the ceiling or wall to provide suspension elements with the correct length and position. One common type of suspension element is wires or rods. Most commonly such wires or rods are oriented in a vertical direction. In some cases two or more wires are interconnected in a point such that they extend at different angles away from the interconnection point to different attachment points. The interconnection point may the connection point at the tile or a point located above the tile with a suspension element extending vertically from the interconnection point to the connection point. As mentioned above the framework may be the framework or structure of the building or an intermediate framework.

In the method calculating format, position and orientation for each individual tile in the false ceiling or wall may include calculating a preliminary set of data concerning format, position and orientation for each individual tile, calculating, based upon said preliminary set of data, acoustical properties of a space in which said false ceiling or wall is adapted to be installed, based upon the calculated acoustical properties a) approve said preliminary set of data as the data to be used for further processing in preparation for production of the tiles, or b) recalculate a new set of preliminary data concerning format, position and orientation for each individual tile to be used for a new calculation of acoustical properties of said space.

With this set-up it easily becomes possible to make alterations in the ceiling or wall design in order to take the acoustical properties in consideration. Before the new set of preliminary data is calculated the user may e.g. indicate that the software should suggest a new design with improved acoustical properties. Alternatively, the user may e.g. change the overall design of the ceiling or wall (for the complete wall or in a critical area) or the user may change some of the boundary criteria or design criteria (overall or in a critical area) with the aim of allowing the new preliminary set of data to result in a ceiling or wall with improved acoustical properties.

The acoustical properties may e.g. include providing a desired sound attenuation or providing a desired sound reflection. It is e.g. in office buildings or schools often desirable to provide a sufficient sound attenuation. In a theatre it may be desirable to direct sound originating from the scene to the audience by providing a certain combination of the sound reflection and sound attenuation.

In the method calculating format, position and orientation for each individual tile in the false ceiling or wall may include calculating a preliminary set of data concerning format, position and orientation for each individual tile, calculating, based upon said preliminary set of data, heat transfer and/or air flow properties of a space in which said false ceiling or wall is adapted to be installed, based upon the calculated heat transfer and/or air flow properties a) approve said preliminary set of data as the data to be used for further processing in preparation for production of the tiles, or b) recalculate a new set of preliminary data concerning format, position and orientation for each individual tile to be used for a new calculation of heat transfer and/or air flow properties of said space.

In the method calculating format, position and orientation for each individual tile in the false ceiling or wall may include calculating a preliminary set of data concerning format, position and orientation for each individual tile, calculating, based upon said preliminary set of data, light properties of a space in which said false ceiling or wall is adapted to be installed, based upon the calculated light properties a) approve said preliminary set of data as the data to be used for further processing in preparation for production of the tiles, or b) recalculate a new set of preliminary data concerning format, position and orientation for each individual tile to be used for a new calculation of light properties of said space.

The calculating of light properties may e.g. include a calculation of how the light from lighting fixtures spreads in the space and may also include a calculation of how light from windows of light wells spreads in the space. The way the light spreads in the space may e.g. be influenced by altering the angular positions of the tiles or by altering the properties of the surface layer of the tiles, such as the colour and the reflectivity of the surface layer.

With this set-up it easily becomes possible to make alterations in the ceiling or wall design in order to take the heat transfer and/or air flow properties in consideration. Before the new set of preliminary data is calculated the user may e.g. indicate that the software should suggest a new design with improved heat transfer and/or air flow properties. Alternatively, the user may e.g. change the overall design of the ceiling or wall (for the complete wall or in a critical area) or the user may change some of the boundary criteria or design criteria (overall or in a critical area) with the aim of allowing the new preliminary set of data to result in a ceiling or wall with improved heat transfer and/or air flow properties.

The above object has been achieved by a method of installing a false ceiling or wall comprising a plurality of ceiling or wall tiles, the tiles being mineral fibre based compressed tiles, each having a front major surface being adapted to be visible, an opposing back major surface and one or more edge surfaces extending along the perimeter of the tile and connecting the front and back major surfaces, as indicated in the introductory part of the specification and relating to the installation of a false ceiling or wall, preferably a suspended ceiling or wall.

The method is characterised in that it comprises:

providing a plurality of tiles, each with an individually calculated format and each being provided with a unique tile identity of respective tile, providing a representation of the false (preferably suspended) ceiling or wall including an association of the position of respective tile with respective tile identity, identifying the identity of a tile, determining the intended position for the identified tile based on the representation of the false (preferably suspended) ceiling or wall including the association of the position of respective tile with respective tile identity, installing the identified tile in its intended position by attaching it to a framework of a building or (preferably) by suspending it from a framework of a building or in a grid system suspended from a framework of a building.

This way the person installing the ceiling or wall may easily and securely install the ceiling or wall in the correct manner even though the tiles each has a calculated format and even though the ceiling or wall itself has a complex shape. This method of installing the ceiling or wall allows an architect to design the ceiling or wall in a complex manner and still keeping installation cost and effort at a commercially viable level.

Preferred embodiments of the invention appear in the dependent claims.

Each tile may be provided with a tile identity or tile identities of a neighbouring tile or tiles, wherein the method may further comprise orienting the identified tile based on the intended or actual position or positions of the neighbouring tile or tiles, and installing the identified tile in its intended position and orientation by attaching it to a framework or by suspending it from a framework or in a grid system suspended from a framework With the knowledge of the identities and positions of the neighbouring tiles and with the provision of the identities of the neighbouring tiles on the tile being installed it becomes easy to secure that the tile is installed in the correct orientation. This may be especially useful when the tiles e.g. are triangular with all three angles close to 60°. Without this aid in finding the correct orientation it would be easy for the person installing the ceiling or wall to try to install the tile in the wrong orientation. This could e.g. result in an error that need to be corrected later on or in that the tile becomes damaged by hitting neighbouring tiles or by hitting the grid system.

Each tile may be provided with an identification of which of the edge surfaces or which part or parts of the edge surface is intended to be facing a certain neighbouring tile, the method may further comprise orienting the identified tile based on the identification of which of the edge surfaces or which part or parts of the edge surface is intended to be facing a certain neighbouring tile and on the intended or actual position or positions of the certain neighbouring tile or tiles, and installing the identified tile in its intended position and orientation by attaching it to a framework or suspending it from a framework or in a grid system suspended from a framework.

This will make it even easier for the person installing the ceiling or wall to find the correct orientation of the tile he is installing. Different designs of this identification have been discussed above in respect of the corresponding feature in the method of preparing the installation of the ceiling or wall.

The above object has also been achieved by a tile for use in a false ceiling or wall comprising a plurality of tiles, the tile being a mineral fibre based tile having a front major surface being adapted to be visible, an opposing back major surface and one or more edge surfaces extending along the perimeter of the tile and connecting the front and back major surfaces, as indicated in the introductory part of the specification.

The tile is characterised in that it is provided with a unique tile identity identifying said tile, and wherein the tile is provided with a tile identity or tile identities of a tile or tiles intended to be positioned as a neighbouring tile or neighbouring tiles in a false (preferably suspended) ceiling or wall. This may used for the person installing the ceiling or wall to securely install respective tile in the correct orientation. It also facilitates the next step for the person installing the ceiling or wall, since the identities of the next tiles to be retrieved and installed are indicated on the tile presently being installed.

The tile may be provided with an identification of which of the edge surfaces or which part or parts of the edge surface is/are intended to be facing a certain neighbouring tile. The design and advantages has been discussed above in respect of the corresponding feature in respect of the method of preparation of the installation and reference is made to that discussion.

The tile may be provided with a marking positioned on the back major surface and in the vicinity of an edge surface, the marking being intended to be positioned in relation to a corresponding marking on a neighbouring tile. The marking may e.g. be a line adapted to be aligned with a corresponding line on a neighbouring tile. This will facilitate correct positioning of the tile in the ceiling or wall.

The tile may be provided with a marking on its major back surface, the marking indicating where a connection element is adapted to be connected to the tile, wherein the connection element is adapted to directly or indirectly connect said tile to a neighbouring tile. This will facilitate correct positioning of the connection element in relation to the tile and will in turn facilitate correct positioning of the tile in relation to its neighbouring tiles.

The tile may be provided with a connection element on the back major surface, the connection element being intended to directly or indirectly connect said tile to a neighbouring tile e.g. by the connection element being connected to a corresponding connection element on a neighbouring tile. With a preinstalled connection element on the back major surface of the tile, it becomes easy for the person installing the ceiling or wall to install the tile in the correct position. Moreover, it is easier to secure that the connection element is positioned in the correct position if the connection element is connected to the tile during manufacturing of the tiles compared to if the connection element is to be connected to the tile on site where the ceiling or wall is to be installed.

It may be noted that it is also conceivable with combinations with some tiles provided with a marking on its major back surface, the marking indicating where a connection element is adapted to be connected to the tile, and other tiles provided with a connection element on the back major surface. It is also conceivable that a tile is on one hand provided with a connection element adapted to be connected to directly or indirectly to a first neighbouring tile and on the other hand provided with a marking indicating where a second connection element is adapted to be connected to the tile, wherein the second connection element is adapted to directly or indirectly connect said tile to a second neighbouring tile.

The tile may be provided with a marking on its back major surface, the marking indicating where a suspension element is adapted to be connected to the tile, the suspension element being intended to suspend said tile relative to a framework. This will facilitate correct positioning of the suspension element in relation to the tile and will in turn facilitate correct positioning of the tile in relation to its neighbouring tiles.

The tile may be provided with a connection element on the back major surface, the connection element being intended to directly or indirectly be connected to a suspension element, the suspension element being intended to suspend said tile relative to a framework. With a preinstalled connection element on the back major surface of the tile, it becomes easy for the person installing the ceiling or wall to install the tile in the correct position. Moreover, it is easier to secure that the connection element is positioned in the correct position if the connection element is connected to the tile during manufacturing of the tiles compared to if the connection element is to be connected to the tile on site where the ceiling or wall is to be installed.

The above object has also been achieved by a false ceiling or wall of the kind given in the introductory part of the specification and which is characterised in that it includes a plurality of tiles of the kind discussed above and in that it further comprises at least one connection element interconnecting at least two tiles, wherein the connection element defines a translational position of one of the tiles relative the other tile and/or an angular position of one of the tiles relative to the other tile. The mutual translational position may be defined such that it results in a defined gap of a certain width (uniform or varying along the edge of the tile). The mutual translational position may alternatively be defined such that it results in no gap, e.g. such that the tiles abut each other or such that protrusions and grooves in the edges of the tiles interlock with each other. The mutual translational position may alternatively be defined such that it results in an overlap, e.g. such that one of the tiles is positioned partly above the other in a false ceiling or partly behind the other in a false wall. It may be noted that the mutual translational position may be different in the plane (straight or curved) of the tiles than in the direction defined by the normal of the plane of the tiles. It may e.g. be the case, that two tiles are positioned such that they are spaced apart in the direction of the normal and positioned such that there is no distance along the plane, i.e. such that they would have abutted each other if they had not been spaced apart in the direction of the normal.

The mutual angular position may be defined by the connection element such that the neighbouring tiles extend in a common plane. The mutual angular position may alternatively be defined by the connection element such that the neighbouring tiles at an angle relative to each other. In case of non-planar tiles, the mutual angular position is considered to be the mutual angular position of the part of the tile closest to the neighbouring tile.

It may also be noted that when an entire false ceiling or wall is considered, the mutual translational positions and/or mutual angular positions between neighbouring tiles may be defined differently at different locations of the false ceiling or wall. There may e.g. be provided areas of the ceiling or wall where there is no gap between the tiles and other areas of the ceiling or wall where there is a certain gap between the neighbouring tiles. Such designs may be used to provide certain impressions of the ceiling or wall e.g. to provide guidance. Such designs may also be used as a means to influence other variables, such as ventilation, acoustic properties, lighting, etc.

It may be noted that although the connection element is said to define the mutual translational position and mutual angular position, the connection element need not be strong enough to fully support the weight of a certain tile. The weight of the tiles may e.g. be supported by suspensions elements attached between the tiles and the framework and the forces needed to provide correct mutual positioning is provided by the connection elements interconnecting the tiles. A tile may also be supported by a combination of forces from connection elements and suspension elements.

However, it may also be noted that the connection elements may be used to fully carry the load of one or more tiles in the false ceiling or wall. This may e.g. be useful where it is difficult to find a suitable attachment position in the framework of the building in respect of one or more tiles.

BRIEF DESCRIPTION OF THE DRAWINGS

The invention will by way of example be described in more detail with reference to the appended schematic drawings, which shows a presently preferred embodiment of the invention.

FIG. 2 shows an overview of a plurality of tiles adapted to be installed as an integrated wall and ceiling with a 3-dimensional shape.

DETAILED DESCRIPTION OF PREFERRED EMBODIMENTS

Figure 3:
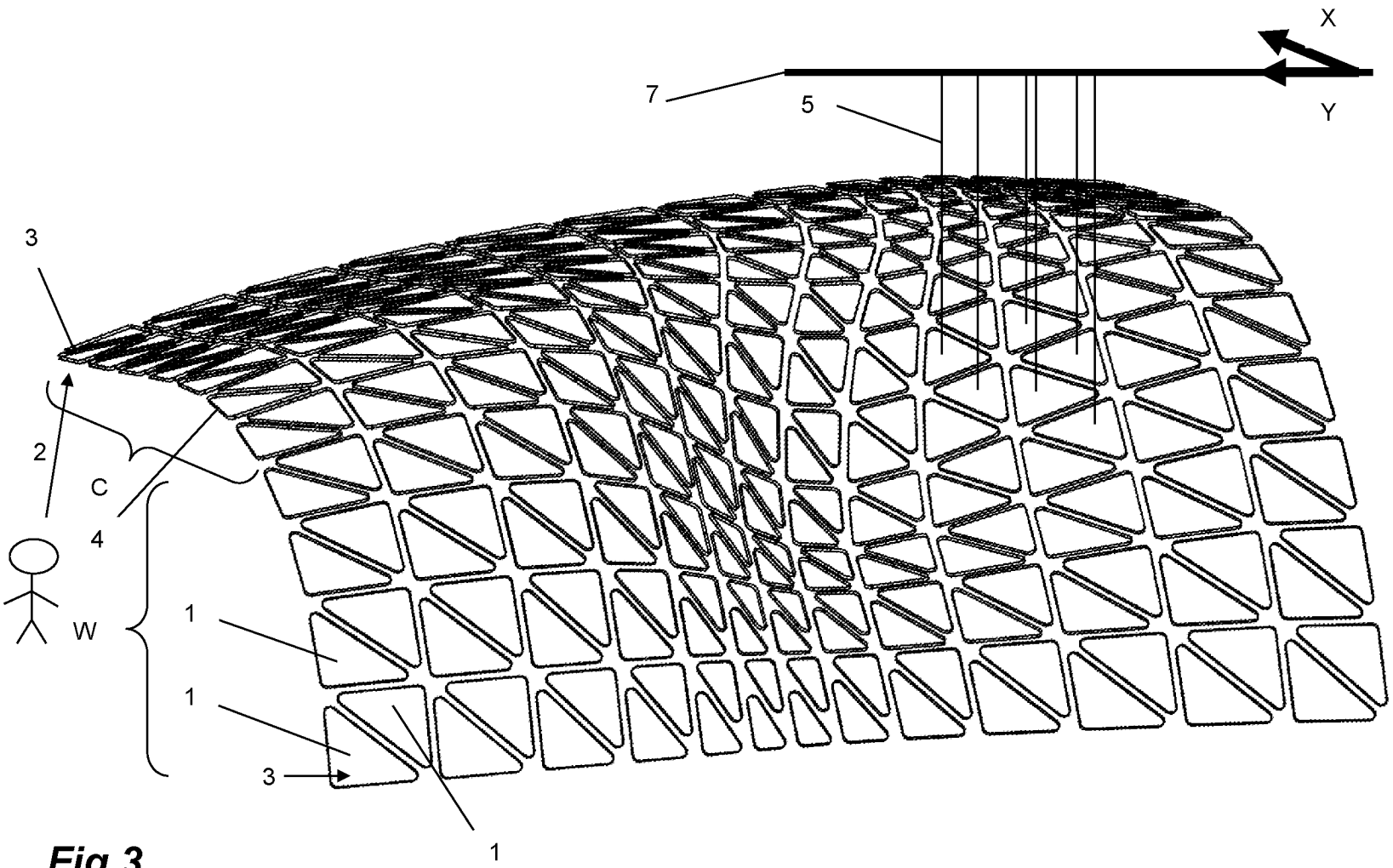
FIG. 3 shows a 3-dimensionally shaped integrated wall and ceiling formed of the tiles shown in FIG. 2.

FIG. 3 discloses a 3-dimensionally shaped suspended wall W, which at its top turns into and continues as a suspended ceiling C. The suspended wall/ceiling W/C is formed of a plurality of tiles 1. In the shown embodiment the tiles 1 are all triangular. The tiles 1 have uniquely calculated format, position and orientation.

The tiles are mineral fibre based tiles. They may e.g. be produced from stone wool or glass fibres. The tiles have a front major surface 2 being adapted to be visible (as is indicated by the arrow 2 from the stick man in FIG. 3). The tiles have a back major surface 3 opposite the front major surface 2. The tiles 1 also have an edge surface 4 extending along the perimeter of the tile and connecting the front 2 and back 3 major surfaces. The triangular tiles in FIG. 4 and FIG. 5 each has three straight perimeter portions and three rounded corners connecting the three straight portions. The rectangular tiles in FIG. 6 and FIG. 9 each has four straight perimeter portions interconnected in relatively sharp corners. In the figures the edge surfaces 4 of the tiles are formed of a straight line extending in the normal direction of the front and back major surfaces. It may be noted that it is common to provide the edge surface with other shapes, such as providing the edge surface with grooves and steps extending along the perimeter or providing the edge surface in an angle relative to the normal direction. It may be noted that although it is most preferred, the front and back major surfaces need not be parallel to each other.

Figure 7:
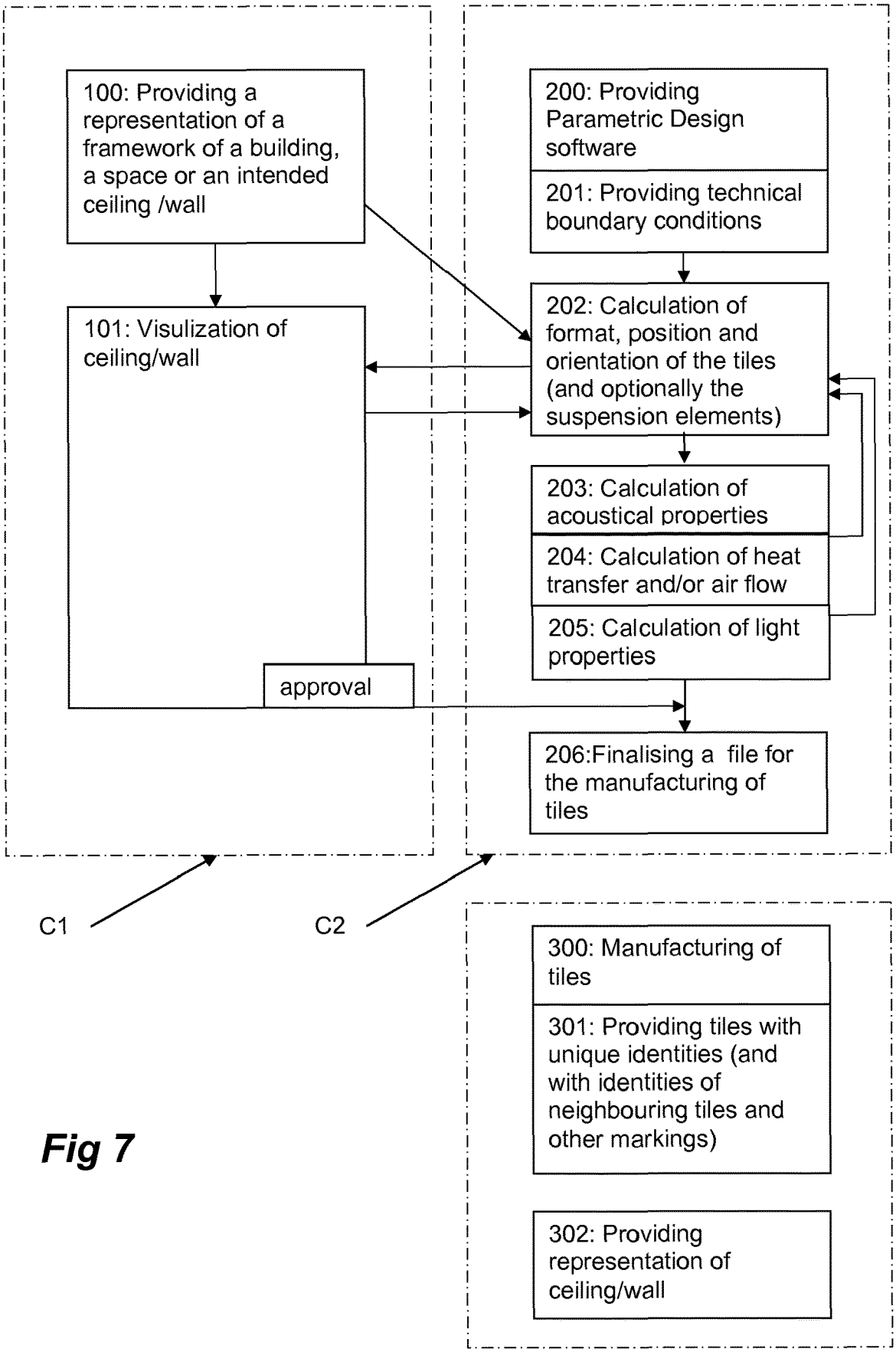
FIG. 7 is a schematic representation of a method of preparing an installation of a suspended ceiling or wall.
Figure 8:
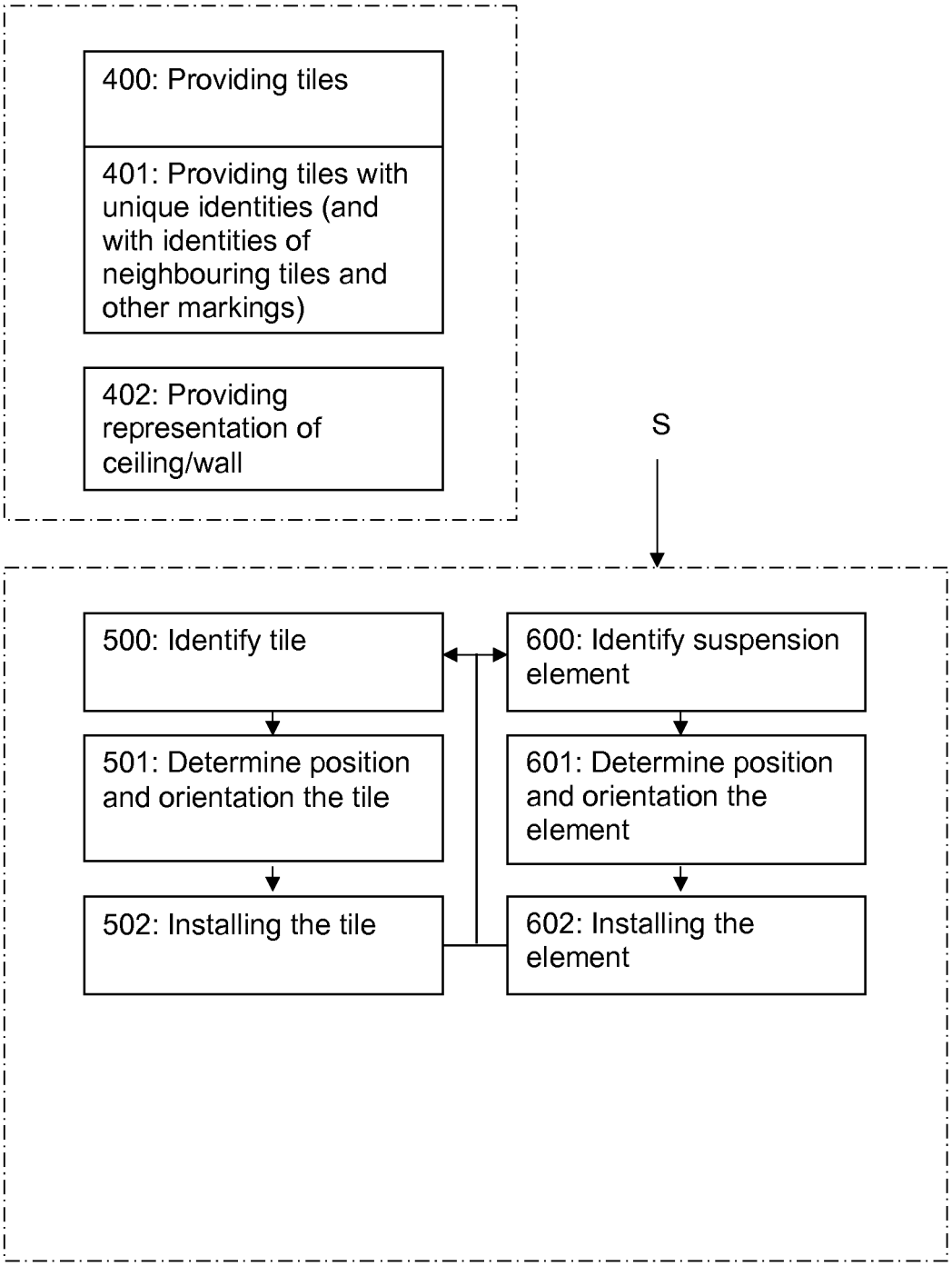
FIG. 8 is a schematic representation of a method of installing a suspended ceiling or wall.

In order to make installation feasible, the preparation of the installation and the installation is performed in accordance with the preferred methods that will be described in the following. The method of preparing installation is schematically indicated in FIG. 7. The method of installing the ceiling or wall is schematically indicated in FIG. 8.

As indicated in FIG. 7, an architect or the like will provide input data 100 on a first computer C1. This input data may e.g. include a representation of the framework of an existing building or a building to be built, a representation of a space in which the suspended ceiling or wall is to be installed or a representation of the intended ceiling or wall. Depending upon the level of knowledge the architect possess in the field of designing suspended ceiling or walls, the input data may be anything from very vague to very well defined concerning the intended design of the ceiling/wall. In one embodiment this input data 100 will be exported from the first computer C1 as a set of input data and imported into a second computer C2, remote from the first computer C1, via a network interface, such as via internet. In another embodiment, the first computer C1 is communicating with the second computer C2 via an internet interface, such as a standard web browser, and the input data is piecewise communicated directly to the second computer C2 as it is inputted through the web browser. There need not be any actual distance between the computers; they may even be one and the same computer. However, the method allows the two computers to be remote and it is a preferred set-up that the two computers are remote. Such a set-up allows the architect or the like (providing the input data) and the manufacturer or the like (typically providing the computer running the calculation software) to be at different locations anywhere in the world.

In the second computer C2 a Parametric Design Software is provided 200. In this second computer C2 there is also provided some boundary conditions concerning what is technically feasible. This may e.g. include boundaries concerning minimum and maximum sizes of the tiles, minimum strength, maximum weight, etc. It may be noted that the second computer C2 may be a set of computers.

Based on the input data 100 and the boundary conditions 201, the parametric design software 200 will in step 202 calculate format, position and orientation, for each individual tile in the suspended ceiling or wall. This will result in a first set of output data which will be representing the ceiling/wall and which may be exported to the first computer C1 for visualization 101 in the design software used by the architect. Alternatively or as a complement the output data may also serve as a preliminary set of data concerning format, position and orientation for each individual tile. This preliminary set of output data may be used in a further step 203 in which the acoustical properties are calculated. If the acoustical properties are at a desired level, the preliminary data used may be approved for further processing. This further processing may be preparation for manufacturing 206 or may include further calculations concerning e.g. heat transfer and air flow properties 204 or further calculations concerning light properties 205. If the heat transfer and/or the air flow and/or the light properties are at a desired level the preliminary data may be approved for further processing 206 in preparation for the manufacturing. If the acoustical properties or the heat transfer or the air flow of the light properties are not at a desired level, a request for recalculation of the format, position and orientation of the tiles is made. As input for this recalculation, the computer software may be programmed to provide guidance concerning design changes of the ceiling/wall that will have a positive influence on the acoustical properties, heat transfer, air flow and/or light properties. Alternatively, the user (architect) may use trial and error based on his level of knowledge. Alternatively, the manufacturer may provide input as a service or even take charge and provide a suggested design of the ceiling/wall, which design will use the architects design as a point of departure and will take acoustical properties, heat transfer, air flow properties and/or light properties into consideration. It may be noted that of course other technical properties may be considered.

In FIG. 7, a preferred order of steps is disclosed. It may however be noted that e.g. the calculation of acoustical properties and heat transfer and air flow and light properties may be performed in parallel or in the opposite order. It is also conceivable that the user may indicate which property is the important one and that the calculation of that property is performed first and need to be approved first.

Once the architect is satisfied with the design of the suspended ceiling/wall C/W and the calculated technical properties has been approved, the computer software in the second computer C2 may be set to finalise the calculation in preparation for manufacturing of the tiles. This data includes format (including shape and size) for each individual tile and an association of each individual tile with a unique tile identity. In the preferred embodiment it also includes information concerning the neighbouring tiles and preferably also the position and orientation of respective tile.

Figure 1:
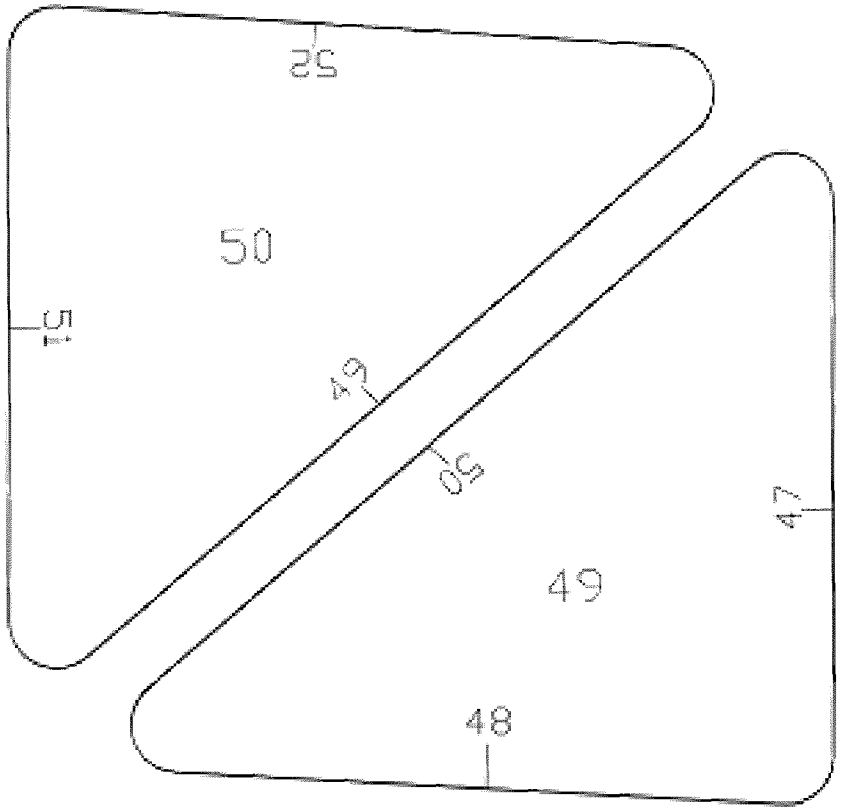
FIG. 1 shows two tiles as viewed from their back major surface.

This information is used for the manufacturing 300 of the tiles. The tiles are also provided 301 with information concerning the tile identity. This may e.g. be performed by providing a marking on the back major surface as is shown in FIG. 1. The lower left tile is provided with the tile identity 50 positioned at the centre of the tile. The upper right tile is provided with the tile identity 49 at the centre of the tile. As is shown in FIG. 1, the tile nr 50 is provided with a marking 49 dose to the edge that is intended to be facing the tile nr 49. Likewise, the tile nr 49 is provided with a marking 50 close to the edge that is intended to be facing tile nr 50. It may be noted that tile nr 49 is intended to be positioned with tile nr 48 at its right edge and tile nr 47 at its upper edge and that tile nr 50 is intended to be positioned with tile nr 52 at its left edge and tile nr 51 at its lower edge.

In the embodiment disclosed in FIG. 1, the marking is also provided with a short line extending between the number indicating the identity of the neighbouring tile and the edge actually intended to be facing said neighbouring tile. The short lines of the neighbouring tiles are intended to be aligned when the two neighbouring tiles are positioned correctly in the direction transverse to said short line.

As a preparation before the installation of the suspended ceiling/wall C/W there will also be provided 302 a representation of the suspended ceiling or wall including an association of the position of respective tile with respective tile identity. A graphic variant of such a representation is e.g. shown in FIG. 2. For clarity reasons has only the tile identities nr 47-52 been included in the enlargement of the lower left corner of the representation in FIG. 2. The representation may also be in the form of a table e.g. including information concerning the identity of each tile, the intended position of each tile, the identity of the neighbouring tiles of each tile, the identity of the suspension element(s) intended for each tile, the identity of the connection element(s) intended for each tile. An example of such a table is shown below.

| Tile ID | Position | Connect to Tile ID (s) | Supported by Suspension element X | Connected to neighbours by Connection element Y |
|---|---|---|---|---|

As a complement or as a separate representation, a representation in the form of guide lines or guide markings or a complete depiction of the false ceiling or wall may be projected onto the structure (such as a wall or the inside of a roof) of the building. The representation may e.g. be projected as a so-called augmented reality.

Figure 4:
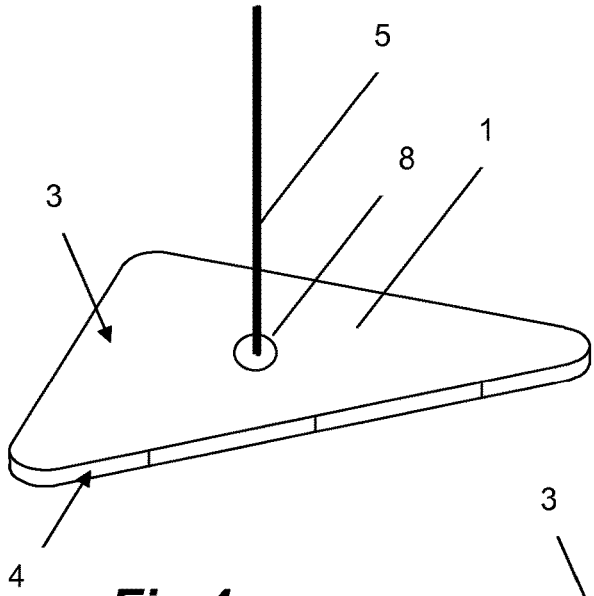
FIG. 4 shows a single triangular tile suspended by a suspension element.

As is schematically shown in FIG. 3 (in respect of five tiles in the upper right corner of FIG. 3) and in more detail in FIG. 4, the tiles are suspended by suspension elements in the form of wires 5. In one embodiment the suspension elements 5 are connected to the centre of gravity of the tiles, such as in FIG. 3, FIG. 4 and FIG. 6. In another embodiment (disclosed in FIG. 5 and FIG. 9) the tiles 1 are interconnected with connection elements 6 and are thereby held in correct place relative each other. These connection elements 6 are used as anchor points for the suspension elements 5. It is also conceivable to use a variant of these two embodiments; the tiles may be supported by suspension elements attached to the back major surface 3 of the tiles 1 and the tiles 1 may also by interconnected by connection elements 6 (however not serving as anchor points for any suspension elements 5). It is also conceivable to use combinations of these three variants. In such a variant some tiles (but not all) are interconnected with connection elements 6, some tiles are suspended directly in the centre of gravity, some tiles are supported directly in the back major surface 3, and some tiles are supported by the connection elements 6 acting as anchor points for the suspension elements 5. It may be noted in this context that the tiles 1 need not be suspended in the centre of gravity. Respective tile 1 may also be suspended by more than one suspension element 5 attached directly or indirectly to respective tile. The suspension elements 5 may e.g. be three in number and attached to the points indicated in FIG. 11 as the connection points 13.

Figure 5:
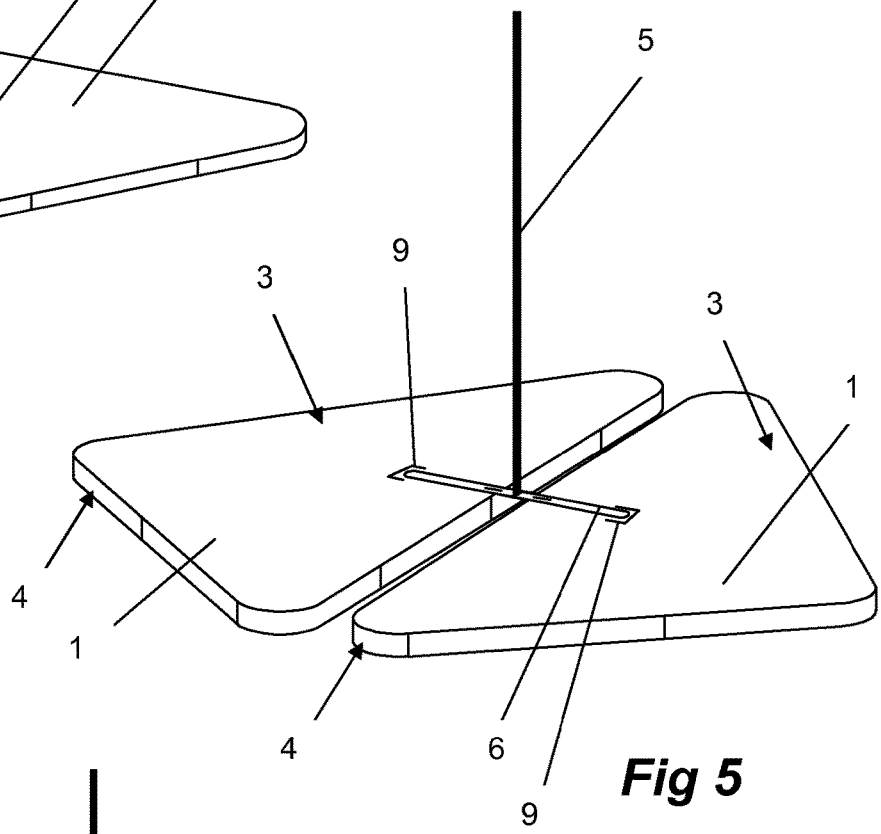
FIG. 5 shows two triangular tiles connected to each other via a connection element and wherein a suspension element is attached to the connection element.
Figure 6:
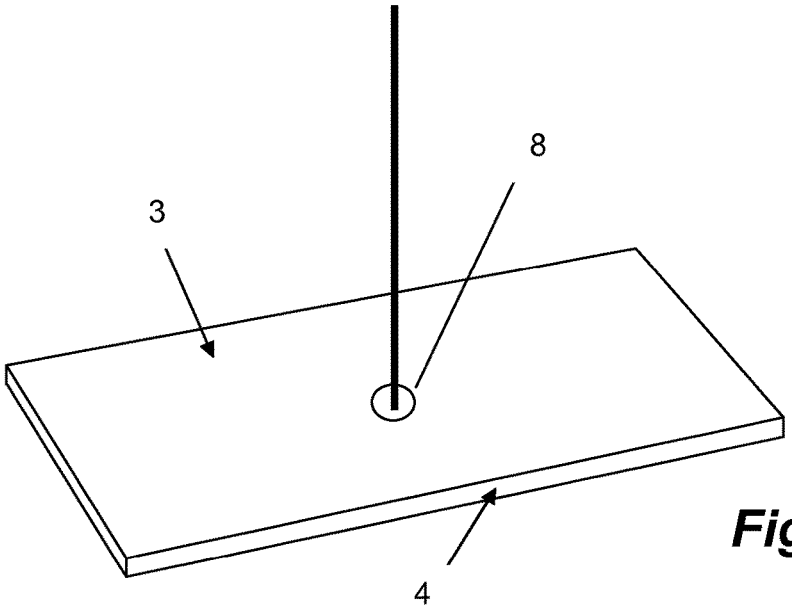
FIG. 6 shows a single rectangular tile suspended by a suspension element.

In order to facilitate correct positioning of the suspension elements 5, the tile 1 may be provided with a marking 8 indicating the correct position of the suspension element 5. In FIG. 4 and FIG. 6 it is schematically indicated by a circle 8. Similarly the tiles 1 may also be provided with a marking 9 indicating the correct position of connection elements 6 interconnecting tiles. In FIG. 5 this marking 9 is schematically indicated by a U-shaped marking 9.

Alternatively, instead of attaching connection elements on site it is conceivable that connection elements are attached to the tiles in connection with the manufacturing of the tiles.

Figure 9:
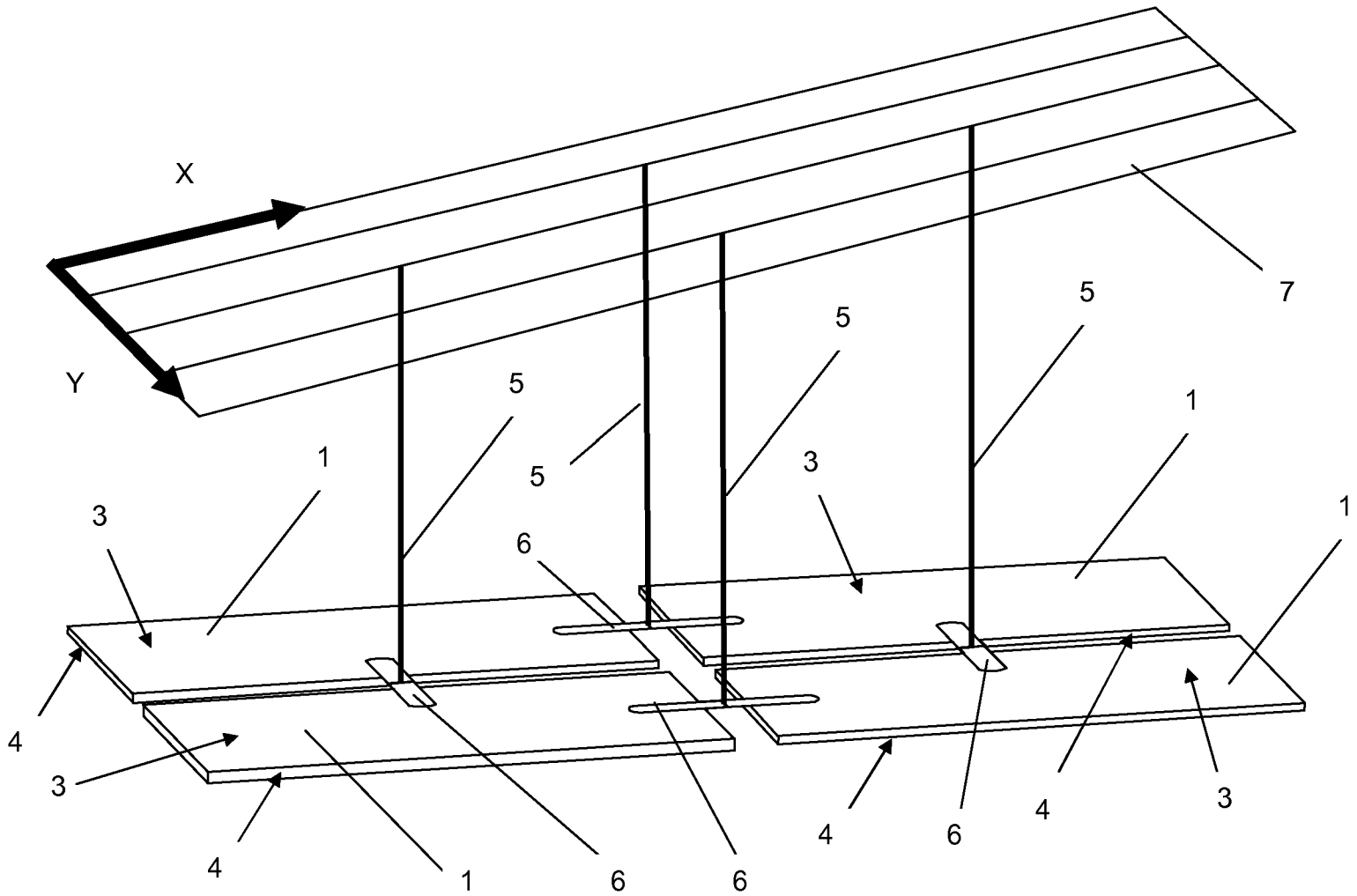
FIG. 9 shows four rectangular tiles connected to each other two and two via a connection element and wherein a suspension element is attached to each of the four connection elements.

In FIG. 3, the framework of the building from which framework the suspended ceiling is adapted to be suspended is schematically indicated by the horizontal line 7. In FIG. 9, the framework is schematically indicated by the sloping plane indicated by reference numeral 7. The framework 7 may be a part of the structure of the building. Alternatively, the framework 7 may be formed of an intermediate framework 7 attached to or suspended to the framework or structure of the building. The intermediate framework 7 may be formed of a grid system of elongate profiles. Having a framework 7 in the form of an intermediate framework 7 offers a possibility to provide a reference for the ceiling or wall with greater accuracy than is usually the case when it comes to the tolerances for the framework or structure of the building as such.

As may be noted in both set-ups shown in FIG. 3 and FIG. 9, the length of the suspension elements 5 will be different in order to accommodate the difference in distance between the connection point in the tile 1 or connection element 6 and the attachment point in the framework 7. It may also be noted that the suspension elements 5 need not extend directly from the tile 1 to the framework 7. A plurality of suspension elements 5 may e.g. extend from their respective connection points on one or more tiles 1 to a common intermediate junction where this intermediate junction being suspended in the framework 7.

In order to take this into account, the method also includes in step 202 (or as a separate step) the calculation of connection points on the tiles at which connection points the suspension elements 5 are adapted to be attached to the tiles or to connection elements 6 interconnecting tiles for suspension of the tiles 1, and calculating, for each suspension element 5, an attachment position at which attachment position the suspension element is adapted to be attached to the framework 7 of the building. The calculation also includes calculation of orientation and length of said suspension element 5. In the same manner as for the tiles, each individual suspension element is associated with a unique suspension element identity. There will also be a representation of the suspended ceiling including e.g. information concerning the suspension element identity and the calculated connection points, attachment points, orientation and length of respective suspension element. The attachment points may e.g. be indicated as X and Y coordinates relative a zero point as indicated in FIG. 3 and FIG. 9. The representation used for the suspension elements may e.g. be in the form of a table (see below) and a drawing of the building showing the location of the zero point and the direction of the X- and Y-axes (as indicated in FIG. 3 and FIG. 9).

| Suspension element ID | Length (vertical) | Connect to Tile ID | Attachment coordinate X | Attachment coordinate Y |
|---|---|---|---|---|

The suspension elements 5 may as indicated above be formed of rods. Different components adapted to a system with the suspension elements formed of rods are shown in FIGS. 12-20. It may be noted that the suspended ceiling/wall C/W may be formed using only wires as suspension elements or using only rods as suspension elements or using a combination or wires and rods or using a combination with wires and/or rods and other kinds of suspension elements.

Figure 14:
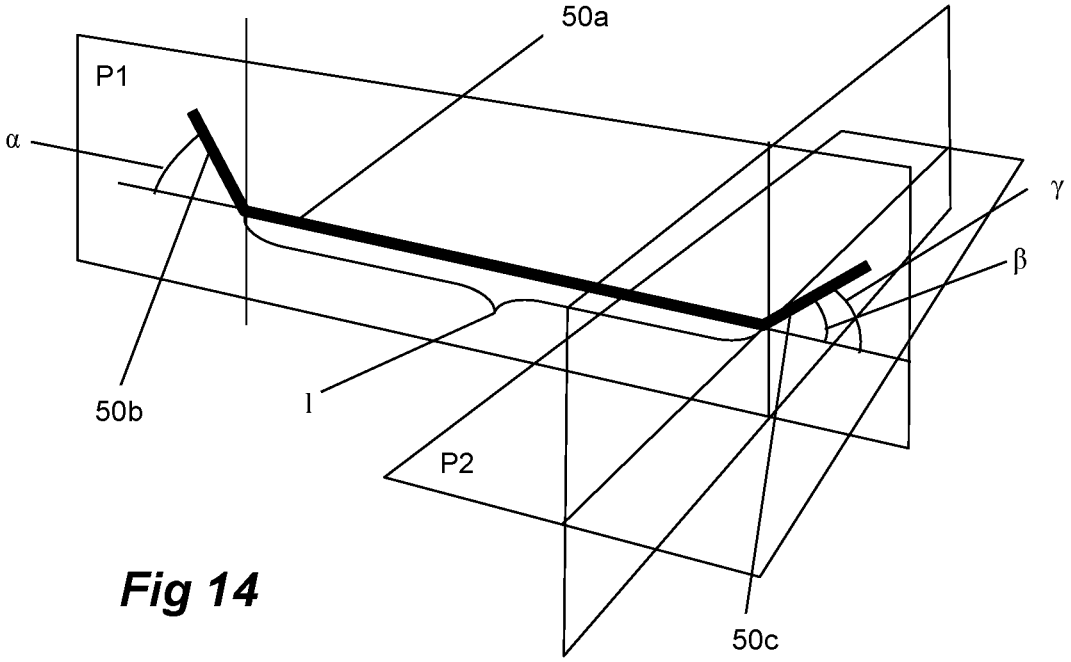
FIG. 14 schematically shows a rod.

In FIG. 14 there is disclosed one embodiment of a suspension element 5 in the form of a rod 50. The rod 50 is uniquely defined using Parametric Design software or the like.

Each rod 50 has a mid-portion 50*a* with a uniquely calculated length 1 and end portions 50*b* and 50*c* with uniquely defined angles relative to the mid-portion 50*a*. The angles may e.g. be defined as a first angle $\alpha$, wherein the mid-portion 50*a* and the end-portion 50*b* defines a first plane P1 in which the angle $\alpha$ resides. The other end-portion 50*c*, extends, relative to the mid-portion 50*a*, a first angle $\beta$ in said plane P1 and a second angle $\gamma$ in a second plane P2 orthogonal P2 to first plane P1. It may also be noted that the angle $\alpha$ may be divided into two angles if the angle $\alpha$ as such is not used to define the plane P1.

Figure 15:
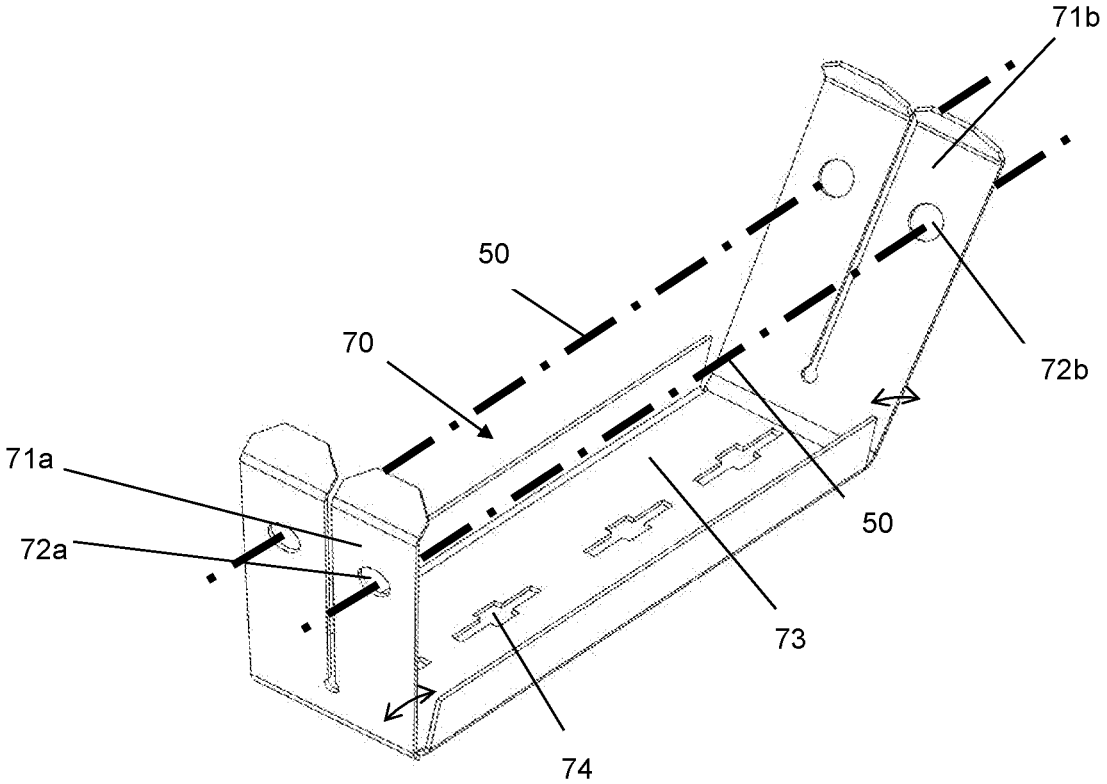
FIG. 15 shows a connection element which on one hand is adapted to receive up to two rods and on the other hand to be connected to one or more tiles.

One of the end portions 50*b*, 50*c* of the rod 50 of FIG. 14 is adapted to be attached to the frame work and the other end 50*c*, 50*b* of the rod 50 is adapted to be attached to a tile directly or via a connection element (e.g. a connection element 70 of the kind shown in FIG. 15). The rods 50 may e.g. be manufactured from circular metal rods being bent in the desired angles.

In the preferred embodiment, the end portions 50*b* and 50*c* are identical for all rods 50 and the unique features of each rod 50 is the length of the mid-portion 50*a* and the angles between the mid-portion 50*a* and respective end-portion 50*b* and 50*c*.

Figure 12:
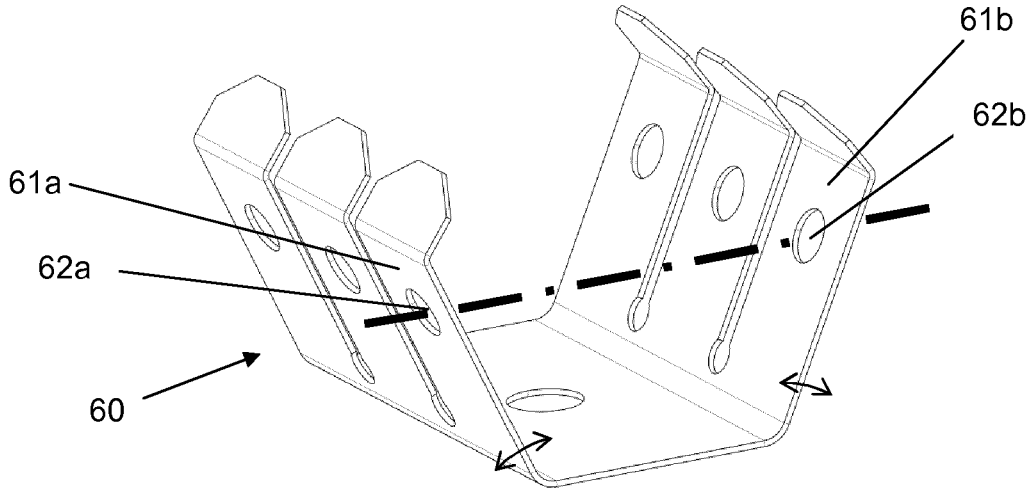
FIG. 12 shows an attachment element adapted to receive up to three rods.

In FIG. 12 there is shown an attachment element 60 which is adapted to receive a rod 50 as indicated by the dash-dot line. Two opposing tongues 61*a*, 61*b* are adapted to flex towards each other as indicated by the arrows at the bottom portion of the tongues 61*a*, 61*b*. This will allow a rod 50 to be inserted into two through-holes 62*a*, 62*b* in respective tongue 61*a*, 61*b*. When the installer releases the tongues 61*a*, 61*b* they flex away from each other again and thereby locks the rod 50 into place by interaction between the edges of the holes 62*a*, 62*b* and the envelope surface of the rod 50.

Figure 13:
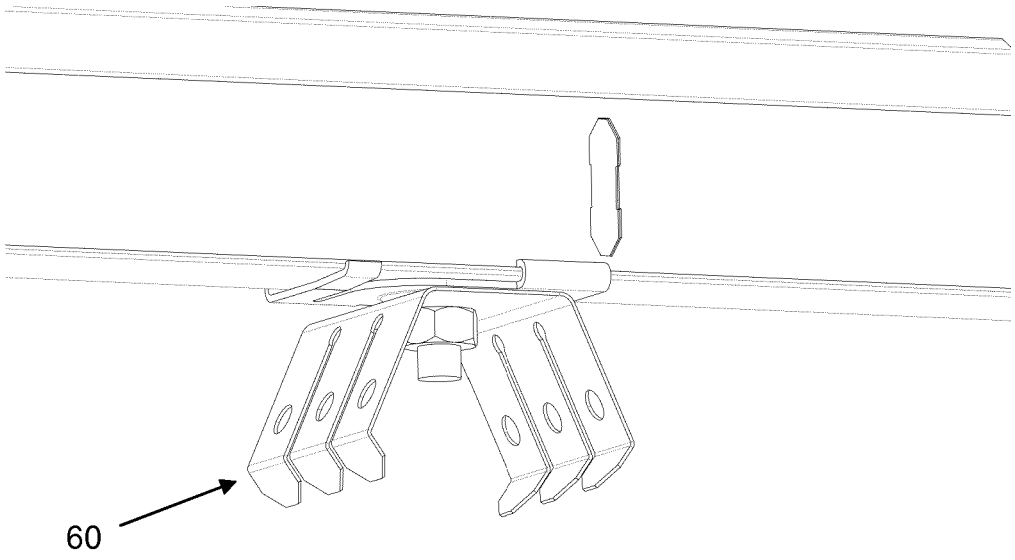
FIG. 13 shows an attachment element of FIG. 12 attached to an elongate profile of a grid system.

As indicated in FIG. 13, the attachment element 60 may be attached to a elongate profile of a grid system.

In FIG. 15 there is disclosed a connection element 70 adapted to be attached to two rods 50. Similarly as for the attachment element 60, the connection element 70 is adapted to receive a rod 50 as indicated by the dash-dot line. Two opposing tongues 71*a*, 71*b* are adapted to flex towards each other as indicated by the arrows at the bottom portion of the tongues 71*a*, 71*b*. This will allow a rod 50 to be inserted into two through-holes 72*a*, 72*b* in respective tongue 61*a*, 61*b*. When the installer releases the tongues 71*a*, 71*b* they flex away from each other again and thereby locks the rod 50 into place by interaction between the edges of the holes 72*a*, 72*b* and the envelope surface of the rod 50. The central portion 73 of the connection element 70 is provided with apertures 74 which are used to connect the connection element 70 directly or indirectly to the tiles of the ceiling or wall.

Figure 16:
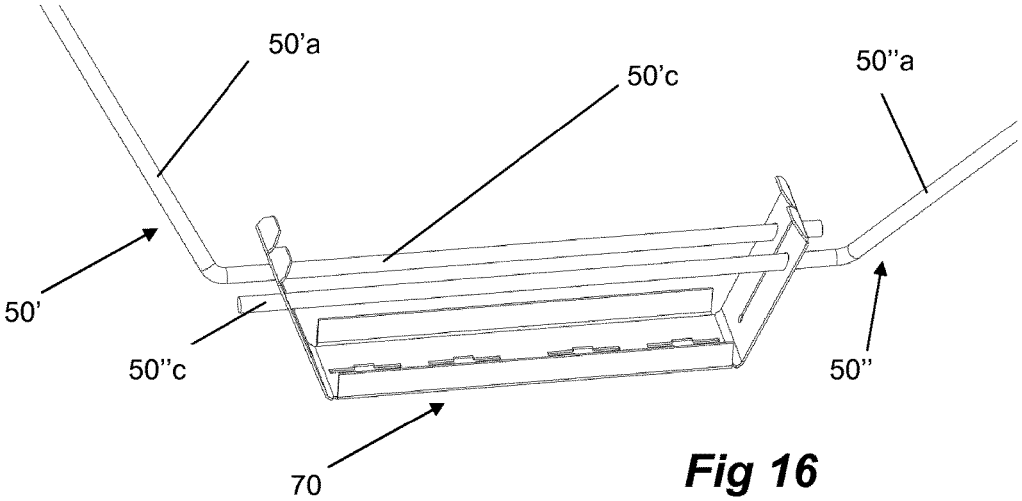
FIG. 16 shows the connection element of FIG. 15 connected to two rods of the kind shown in FIG. 14.

In FIG. 16 there are disclosed two rods 50', 50" attach from two opposite directions of the connection element 70. The rods 50', 50" are of the kind disclosed in relation to FIG. 14.

Figure 17:
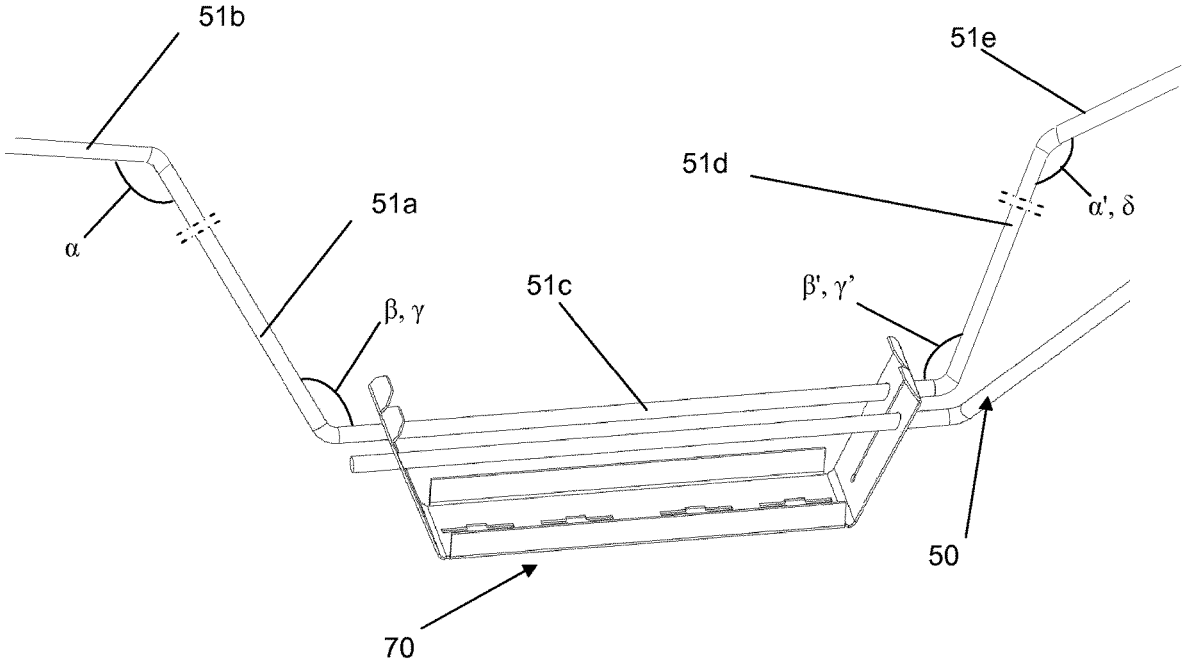
FIG. 17 shows a connection element of FIG. 15 connected to a first rod of the kind shown in FIG. 14 and a second rod provided with a first end adapted to be attached to a first attachment element and a second end adapted to be attached to a second attachment element.

In FIG. 17 there is disclosed on rod 50 of the kind disclosed in relation to FIG. 14 and one variant 51 of this general kind of rod 50. The rod 51 may in one aspect be seen as two rods 50', 50" where the part 50'*c*, 50"*c* attached to the connection element 70 is common. It may also be seen as a rod 50 of FIG. 14 with a first end portion 51*b*, a central portion 51*a* and a second portion 51*c* (no longer an end portion) continued with a second central portion 51*d* and a second actual end portion 51*e* (corresponding to the first end portion). As with the rod of FIG. 14, the first portion 51*b* is angled relative to the central portion 51*a* an angle α and between the portion 51*c* and the central portion 51*a* there is a change in orientation defined as two angles β, γ in two orthogonal planes. The second central portion 51*d* continues in yet another direction defined as two angles β', γ' in two orthogonal planes and finally the end portion 51*e* continues in yet another direction defined as two angles α, δ in two orthogonal planes. In theory all these angles may be defined uniquely using a Parametric Design Software or the like. In practice it is conceivable that one or more of the angles are the same or mirrored each other. This may be due to manufacturing restraints and it may be suitable in order to facilitate correct positioning by the one installing the ceiling or wall. The orthogonal planes related to the different changes in direction, such as between the portions 51*b*, 51*c* and 51*c*, 51*d* may be the same or may be different depending upon the manufacturing process.

Figure 18:
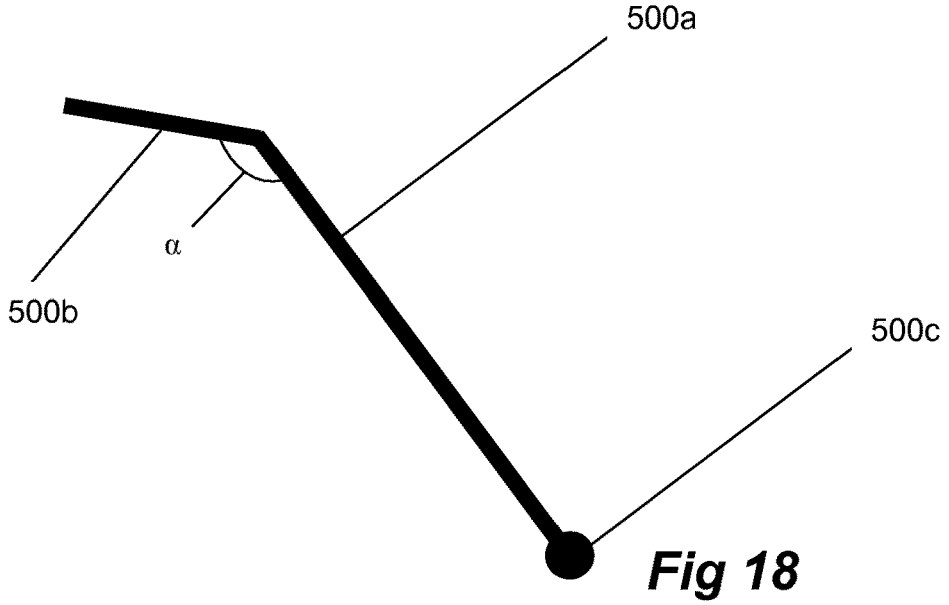
FIG. 18 shows a rod according to a another embodiment.
Figure 19:
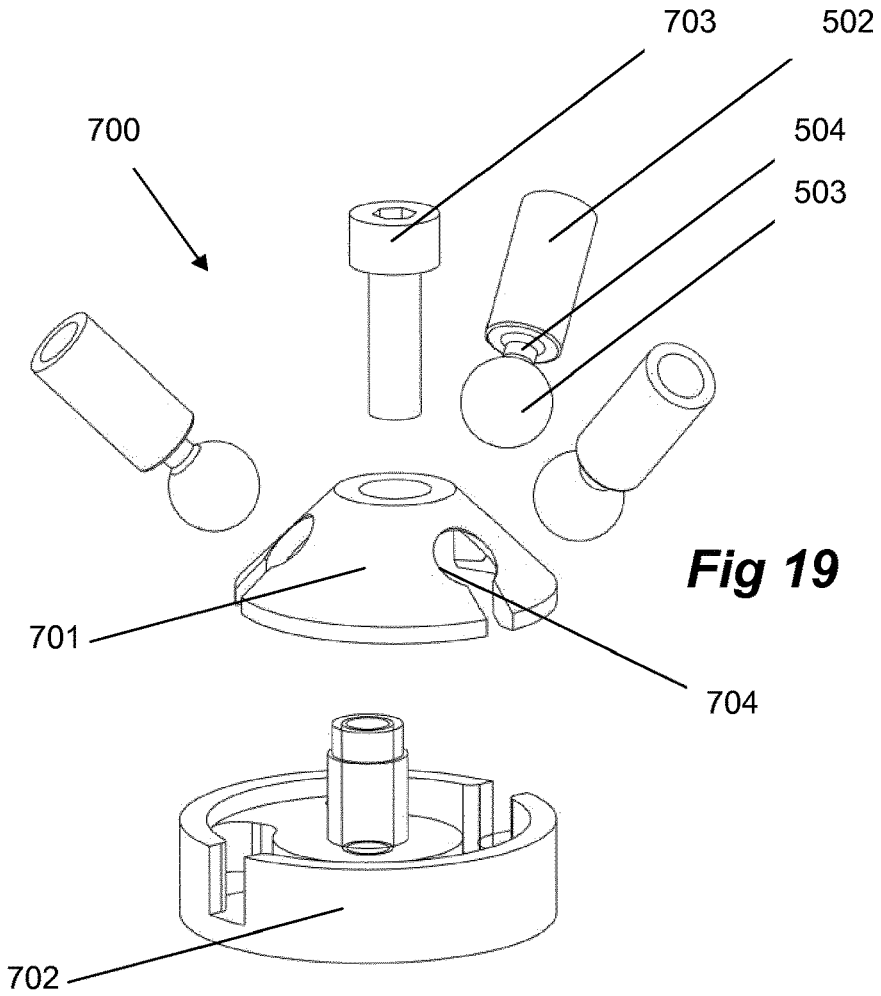
FIG. 19 shows a conical connection element which on one hand is adapted to be attached to up to three rods of the kind shown in FIG. 18 and on the other hand is adapted to be connected to one or more tiles.

In FIG. 18 there is disclosed yet another embodiment of the rod 500. The rod 500 is provided with a central portion 500*a* and a first end portion 500*b* extending at an angle α relative to the central portion 500*a*. The end portion 500*b* is adapted to be installed into an attachment element 60 of the kind disclosed in FIGS. 12 and 13. At the other end the rod 500 is provided with a spherically shaped end 500*c*. In a preferred embodiment the spherical end 500*c* is symmetrical around a geometrical axis extending along the centre line of the extension of the central portion 500*a*. Thereby there is no need for any specific rotational orientation and the end portion 500*b* only need to be defined as a single angle α. The spherical end 500*c* may be manufactured as a separate entity 501 with a sleeve portion 502 (adapted to be attached to the end of the rod, a ball shaped portion 503 forming the spherical end 500*c* and a neck portion 504 with a diameter smaller than the ball shaped portion 503 and the sleeve portion 502. Three such separate entities are shown in FIG. 19. In a preferred embodiment all the rods 500 have identical first end portions 500*a* and identical spherical end portions 500*c* and the unique features of respective rod 500 is the length of the central portion 500*a* and the angle α between the central portion 500*a* and the first end portion 500*b*.

Figure 20:
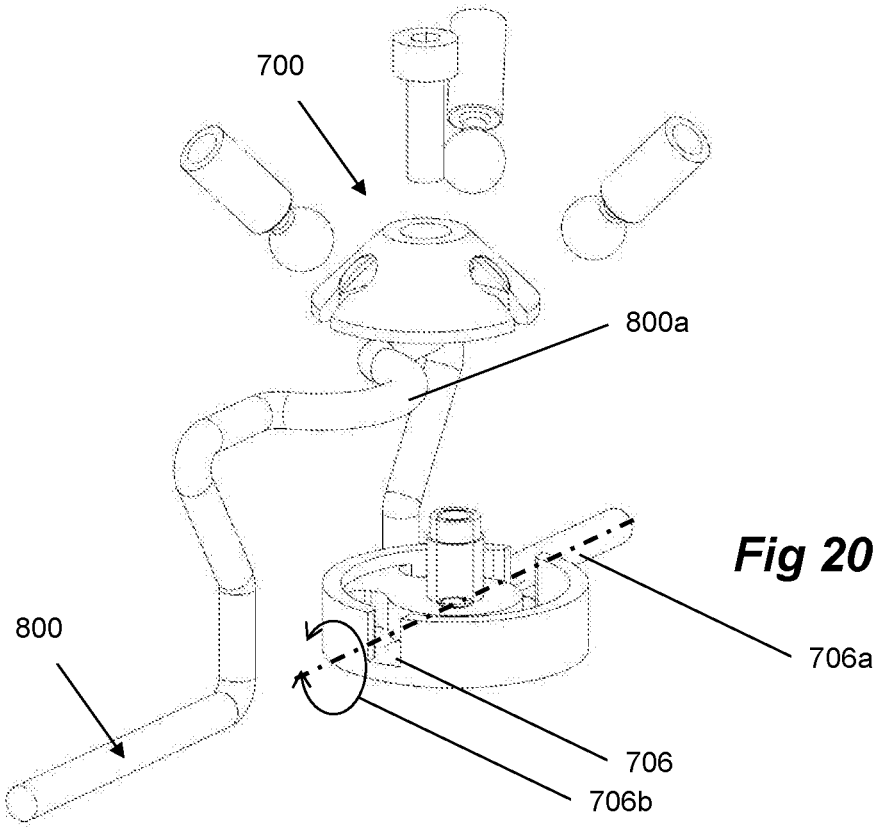
FIG. 20 shows the conical connection element of FIG. 19 and also a further rod shaped connection element adapted to be inserted into the conical connection element.

Rods 500 of the kind disclosed in FIG. 18 may e.g. be installed into a connection element 700 of the kind shown in FIGS. 19 and 20. The connection element 700 is basically formed of a top part 701 and a bottom part 702 between which the spherical ends 500*c* are clamped. The clamping force may e.g. be provided with a threaded screw 703 interacting with its head against the top part 701 and with its threads in a threaded hole in the bottom part 702. The top part 701 is provided with a plurality of keyhole shaped openings 704 allowing the neck portion 504 to enter into position with the ball shaped portion 503 on the inside or underside of the top part 701 and the central portion 500*a* of the rod 500 extending outwardly. The terminology top part 701 and bottom part 702 is related to an example where the connection element 700 is typically arranged in a ceiling. For other purposes the terminology first part 700*a* and second part 700*b* may be more appropriate.

The connection element 700 may be attached to the tiles directly or indirectly and thereby support the ceiling or wall.

In FIG. 20, basically corresponding to FIG. 19, the connection element 700 is adapted to also support a secondary connection element 800 which in turn is adapted to directly or indirectly support the tiles. The connection element 700 is provided with a groove 706 extending through the bottom part 700*b* and facing the upper part 701 such that a secondary connection element 800 inserted into said groove 706 may be damped and held in correct position when the top part 701 and the bottom part 702 are damped together. The clamping may be such that the secondary connection element 800 is fixed relative to the connection element 700. Alternatively, the clamping may be such that the secondary connection element 800 is fixed when it comes to translational movement along the general direction 706*a* of the groove 706 but can still be rotated about the general direction 706*a* as indicated by the arrow 706*b*. In the shown design this may be provided by designing the inside of the connection element 700 such that the bulb shape 800*a* of the connection element can be tilted upwardly inside the conical inside of the connection element 700. If the bulb shape 800*a* is clamped by between the upper part 700*a* and lower part 700*b* there will be no rotational movement between the connection element 700 and the secondary connection element 800.

When it is time to install the suspended ceiling/wall C/W at the building site S tiles that has been produced (step 300) and provided with identities (step 301) are provided (step 400 and 401). There is also provided (step 402) a representation of the ceiling including an association of the position and the tile identity.

The person installing the ceiling/wall C/W identifies the tile (step 500) and if applicable also a suspension element (step 600). Using the representation of the ceiling/wall C/W and information concerning neighbouring tiles provided on the actual tile, the person installing the ceiling/wall C/W determines the intended position and orientation (step 501) and if applicable also the intended position and orientation of the suspension element (step 601). Thereafter the person installing the ceiling/wall C/W will install the tile (step 502) and if applicable also the suspension element (step 602). The marking provided on the back major surface 3 as indicated in FIG. 1 may also be used to facilitate correct orientation and positioning of the tile being installed.

Figure 10:
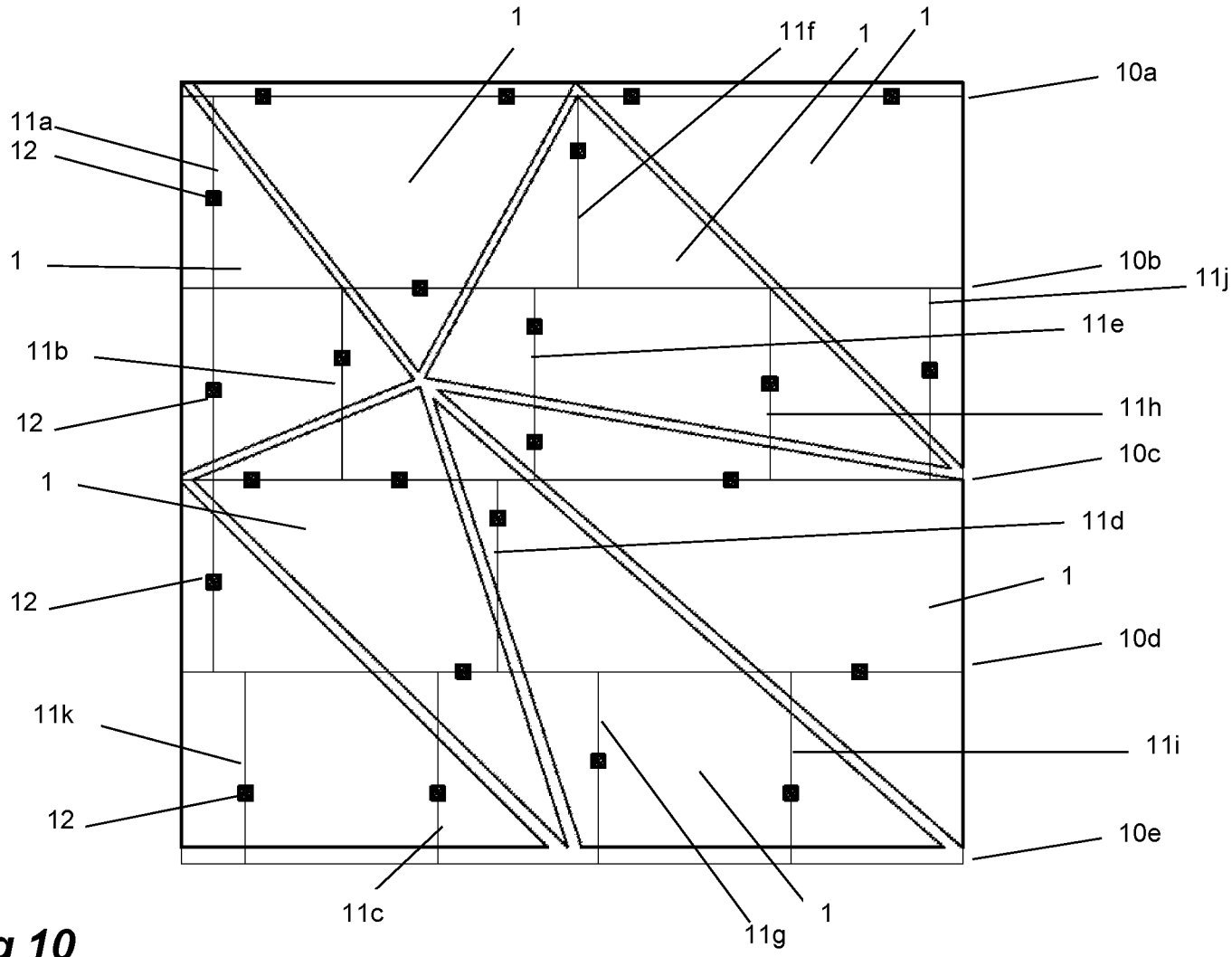
FIG. 10 schematically shows a false ceiling from above or a false wall from behind, wherein a plurality of triangular tiles are connected to profiles using connection elements, and wherein the profiles are arranged in a grid system.

In FIG. 10 a plurality of differently shaped triangular tiles 1 are supported by a grid system. The grid system is formed of a plurality of main profiles 10*a-e* and a plurality of cross profiles 11*a-k*. The main profiles 10*a-e* are arranged equidistantly e.g. at a centre to centre distance of 600 mm, in parallel with each other. It may be noted that the main profiles 10*a-e* may be arranged equidistantly at a different centre to centre distance or that they may be arranged at different mutual distance between different profiles 10*a-e*. In this embodiment, suitable positions of the cross profiles 11*a-k* have been calculated using a Parametric Design Software or the like. The desired format and position of the tiles 1 and technical design criteria e.g. concerning areas on the tiles where it is necessary or suitable to provide support to the tiles has been used as input data. This may e.g. be expressed as a maximum distance between support points on the tile and/or as a maximum distance between an edge of the tile and the closest support point. Based on this, the Parametric Design Software may calculate suitable position of the cross profiles 11*a-k* such that a minimum number of cross profiles 11*a-k* is used to support the tiles 1. The cross profiles 11*a-k* may be placed between the main profiles 10*a-e*, thus forming a grid system with all the profiles in single plane. Alternatively, the cross profiles 11*a-k* may be connected beneath or in front of the main profiles 10*a-e*. In FIG. 10, the tiles 1 are attached to the grid system by connection elements 12 (for reasons of clarity has only the left-most connection elements been identified by a numeral).

In this embodiment, the cross-profiles 11*a-k* are suitably associated with a unique identity and preferably also provided with this unique identity. Moreover, each one of the cross-profiles 11*a-k* is preferably associated with a unique identity and treated in a similar manner as the tiles in the representation of the false ceiling or wall. The main profiles 10*a-e* may be treated as unique items and may alternatively be treated more as a part of the structure or framework of the building.

In one alternative embodiment of the grid system of FIG. 10, the main profiles 10 and cross-profiles 11 are all arranged equidistantly (or at least according to a separately defined predetermined pattern) whereas format, position and orientation of the tiles and the positions of the attachment points where the connection elements connect the tiles to the profiles of the grid system is uniquely calculated according to a Parametric Design software or the like.

The representation of the ceiling or wall may e.g. include information about between which main profiles and at which position along the main profiles relative to a zero point each cross-profile is to be arranged. The representation may also include information concerning at which points on the cross-profiles the connection elements are designed to connect to the cross-profiles. Similarly as for the tiles, the cross-profiles (and main-profiles) may also be provided with markings indicating the positions at with the connection elements are designed to connect to the profiles. The cross-profiles may be provided with marking indicating the identity of each cross-profile. The cross-profiles may also be provided with marking indicating which end should be attached to which main profile. It may be noted that although the example of FIG. 10 only discloses triangular tiles 1 other shapes are also contemplated. The grid system in FIG. 10 is in turn suspended from or attached to the structure or framework of the building. This may be performed in any suitable manner and there exist a number of well-known conventional solutions to this and therefore it will not be discussed in detail. One common way to accomplish this is to suspend the main profiles from the structure of the building and the let the main profiles carry the load from the cross-profiles and the cross-profiles. In other systems also the cross-profiles are suspended to the structure of the building, sometimes more or less by default and other times only locally where necessary due to local additional weight or local difficulties to suspend the main profiles. Suspension of the grid system may also be complemented with direct suspension of tiles or direct suspension of comparatively heavy appliances such as lighting fixtures or the like.

Figure 11:
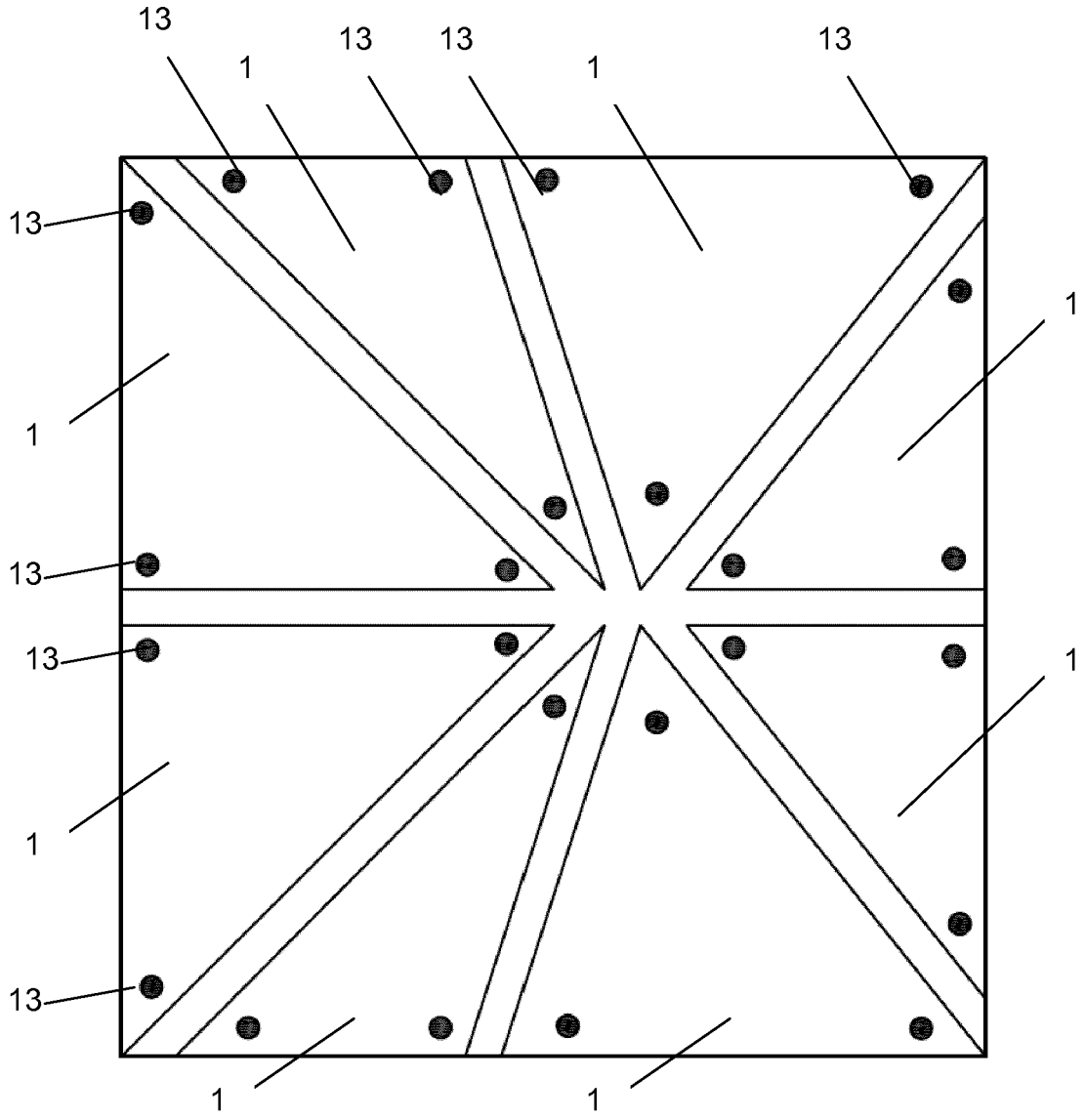
FIG. 11 schematically shows a false ceiling as viewed from below or a false wall as viewed from in front of the wall, wherein a plurality of triangular tiles are attached to the structure or framework of the building using so-called direct fixing.

In FIG. 11 a plurality of differently shaped triangular tiles 1 are attached directly to the structure or the framework of a building. The format, position, orientation, etc of each tile 1 has been calculated in accordance with the above discussed method of preparation of installation and the installation is preferably performed using the above described method of installation. Each tile 1 is attached directly to the structure or framework of the building at attachment points 13 (for reasons of clarity has only the left-most and uppermost attachment points been identified by a numeral). The attachment at the attachment points 13 may e.g. be performed using screws or by using an adhesive between the structure of the building and the tile 1.

Figure 21:
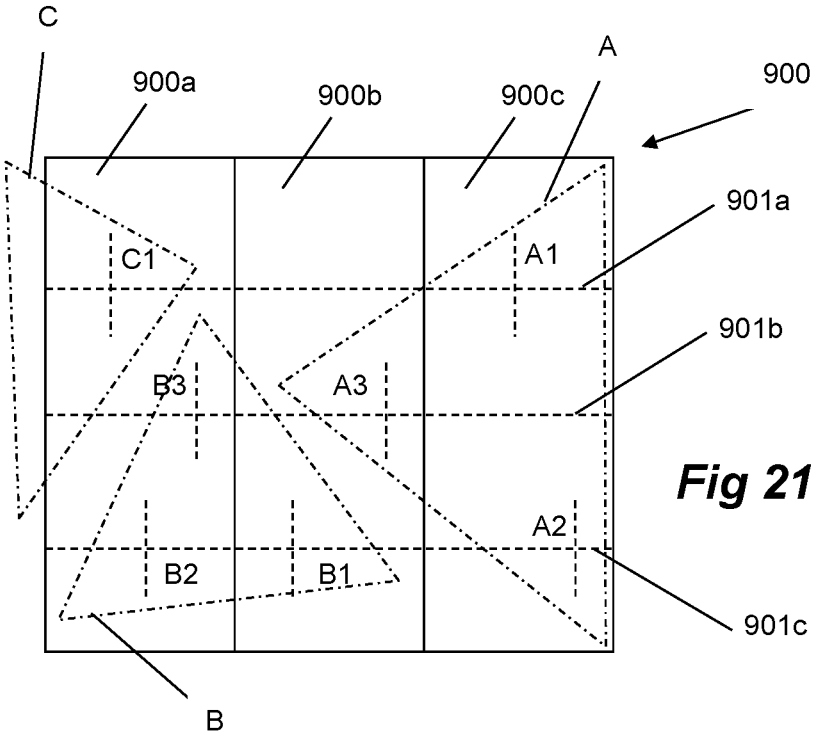
FIG. 21 shows a wall paper which is adapted to the papered onto the framework of the building, such as a structural wall or a structural ceiling, and which is provided with indications concerning positions where different elements of the system are adapted to be attached to the framework of the building.

Correct positioning of the different attachment points on the structural framework of the building, such as a ceiling or wall of the building, may be performed in a plurality of different ways. It is e.g. conceivable to use a laser guiding system indicating the position of the different attachment points with crossing lines of light or with dots of light on the wall or ceiling of the building. The representation of the framework and the ceiling and wall formed of tiles may be used to determine which point is which. In FIG. 21 a wallpaper 900 formed of three drops 900*a-c* side by side. The wallpaper 900 is in FIG. 21 provided with lines 901*a-c* extending across more than one drop, in FIG. 21 across all three drops 900*a-c*, whereby correct relative positioning in height is provided for. It may be noted that the lines 901*a-c* may be replaced with other kinds of markings, such as a short line close to the edge or an arrow or any other pattern that provide sufficient information for correct relative height positioning. The horizontal relative positioning of the different drops 900*a-c* may be accomplished by prescribing wallpapering edge-to-edge or by providing vertical lines or other markings indicating correct overlap of the different drops 900*a-c*.

One alternative is to print information concerning the position (and maybe also the identification) of the different attachment points on a wallpaper or the like. By first wallpapering the structural wall with this wallpaper, the different positions of the attachment points is distinctly defined.

The wallpapering may e.g. be used for cases where tiles are attached directly to the structural wall. In the example shown in FIG. 21 some of the attachment positions for three tiles A, B, C are indicated. For tiles A and B there are indicated three attachment positions A1, A2, A3, B1, B2, B3 each and for tile C there is indicated one attachment position C1 within the three drops 900*a-c* shown in FIG. 21.

Other approaches with templates (other than wallpaper) provided with information concerning positions (and maybe also identifications) of the different attachment points are also conceivable.

It may also be noted that the terms height, horizontal, vertical etc are related to the example of wallpapering a wall. If the wallpapering is used in any other direction, the discussion concerning height and vertical direction is in general terms to be referred to as along the length of the drops and the horizontal direction is in general terms related to directions across the length of the drops, i.e. along the width of the drops of wallpaper.

It is contemplated that there are numerous modifications of the embodiments described herein, which are still within the scope of the invention as defined by the appended claims.

Although the tiles have been disclosed in the figures as planar tiles, the invention is applicable also for non-planar tiles.

Although the tiles have been disclosed in the figures as tiles with perimeter formed of straight edges (and in some cases with rounded corners), the inventions is applicable also for tiles having other geometrical shapes, such as circles, ovals, ellipsoids, other polygons than the disclosed triangle and rectangle. The invention is also applicable for tiles having shapes being combinations of such shapes. The invention is in fact applicable for tiles having basically any free-form shape as long as the tile can be manufactured and the tile can present sufficient strength.

It may also be noted that the tiles may have complex shapes both when it comes to being non-planar and when it comes to the shape of the perimeter.

It may also be noted that in this disclosure, the shape of the edge between the front and back major surfaces has not been discussed. There exist today a great number of differently shaped edges for different purposes and such edges will continue to be developed for different purposes. The disclosed inventive concept does not impose and specific requirements concerning the design of the edge.

The invention claimed is:

1. Method of preparing and installing a 3-dimensionally extending false ceiling or wall having a shape of a 3-dimensionally extending surface, the 3-dimensionally extending false ceiling or wall comprising a plurality of flat ceiling or wall tiles, the flat tiles being mineral fibre based tiles, each having a front major surface being adapted to be visible, an opposing back major surface and one or more edge surfaces extending along the perimeter of the flat tile and connecting the front and back major surfaces, wherein the front and back major surfaces are parallel to each other, and wherein the flat tiles are adapted to be connected to and suspended to a framework by a plurality of elongated suspension elements and thereby form said 3-dimensionally extending false ceiling or wall, the method comprising:

calculating format, position and orientation for each individual flat tile in the 3-dimensionally extending suspended ceiling or wall, associating each individual flat tile with a unique tile identity, producing the individual flat tiles according to the calculated format, and providing each respective flat tile with its respective tile identity, providing a representation of the 3-dimensionally extending false ceiling or wall including an association of the position of each respective flat tile with its respective tile identity, and calculating at least one of positions of connection points on the flat tiles for each one of said individual flat tiles for which said format, position and orientation in the 3-dimensionally extending false ceiling or wall have been calculated, and positions of connection points on connection elements interconnecting said individual flat tiles for which said format, position and orientation have been calculated, wherein the suspension elements are adapted to be attached to the flat tiles or to the connection elements at the calculated connection points for suspension of the flat tiles, providing each respective flat tile with a preinstalled connection element or with a marking indicating where a connection element or a suspension element is adapted to be connected to the respective flat tile, calculating, for each suspension element, an attachment position at which attachment position the suspension element is adapted to be attached to the framework, the calculation being performed relative to a representation of the framework, the calculation also including calculation of orientation and length of said suspension element, associating each individual suspension element with a unique suspension element identity, providing a representation of the 3-dimensionally extending suspended ceiling or wall including an association of the attachment position of each respective suspension element with its respective suspension element identity and including information concerning calculated orientation and length of each respective suspension element with its respective suspension element identity, and installing the 3-dimensionally extending suspended ceiling or wall to a physical location including an a plurality of installed tiles and a plurality of installed suspension elements each comprising an installed connection position of each respective suspension element with its respective installed suspension element identity according to the representation and the calculated orientation and length of each respective suspension element with its respective suspension element identity, wherein the installed connection position of each respective suspension element with its respective installed suspension element identity includes an installed calculated orientation and the installed calculated orientation of at least one of the suspension elements comprises at least one of an acute angle and an obtuse angle of the installed suspension element relative to its respective installed tile.

2. Method according to claim 1, further comprising providing each flat tile with a tile identity or tile identities of neighbouring flat tile or flat tiles.

3. Method according to claim 1, further comprising providing each flat tile with an identification of which of the edge surfaces or which part or parts of the edge surface is/are intended to be facing a certain neighbouring flat tile.

4. Method according to claim 1, further comprising providing a set of input data representing a framework or a space defined by said framework or a surface that said ceiling or wall is intended to form, calculating based on said set of input data, format, position, and orientation, for each individual flat tile in the false ceiling or wall, providing a set of output data representing said ceiling or wall formed by said tiles for visualization of the intended ceiling or wall.

5. Method according to claim 1, the method further comprising calculating for a plurality of the flat tile positions of at least one connection point on each respective flat tile, wherein a connection element is adapted to be connected to each respective flat tile at its respective connection point, wherein the connection element is adapted to directly or indirectly connect said tile to a neighbouring flat tile, and providing each respective flat tile with a marking on its major back surface, the marking indicating the position of said connection point.

6. Method according to claim 1, wherein calculating format, position and orientation for each individual flat tile in the false ceiling or wall includes calculating a preliminary set of data concerning format, position and orientation for each individual flat tile, calculating, based upon said preliminary set of data, acoustical properties of a space in which said false ceiling or wall is adapted to be installed, based upon the calculated acoustical properties a) approve said preliminary set of data as the data to be used for further processing in preparation for production of the flat tiles, or b) recalculate a new set of preliminary data concerning format, position and orientation for each individual flat tile to be used for a new calculation of acoustical properties of said space.

7. Method according to claim 1, wherein calculating format, position and orientation for each individual flat tile in the false ceiling or wall includes calculating a preliminary set of data concerning format, position and orientation for each individual flat tile, calculating, based upon said preliminary set of data, heat transfer and/or air flow properties of a space in which said false ceiling or wall is adapted to be installed, based upon the calculated heat transfer and/or air flow properties a) approve said preliminary set of data as the data to be used for further processing in preparation for production of the flat tiles, or b) recalculate a new set of preliminary data concerning format, position and orientation for each individual flat tile to be used for a new calculation of heat transfer and/or air flow properties of said space.

8. Method according to claim 1, wherein calculating format, position and orientation for each individual tile in the false ceiling or wall includes calculating a preliminary set of data concerning format, position and orientation for each individual flat tile, calculating, based upon said preliminary set of data, light properties of a space in which said false ceiling or wall is adapted to be installed, based upon the calculated light properties a) approve said preliminary set of data as the data to be used for further processing in preparation for production of the flat tiles, or b) recalculate a new set of preliminary data concerning format, position and orientation for each individual flat tile to be used for a new calculation of light properties of said space.

* * * * *